US007047983B2

(12) United States Patent
Manougian et al.

(10) Patent No.: US 7,047,983 B2
(45) Date of Patent: May 23, 2006

(54) PROTECTED CONTAINERS

(76) Inventors: Katherine J. Manougian, 370 Quailhill Dr., Brookeville, MD (US) 20833; Kristi Fratello, 5395 Cross Roads Manor, Atlanta, GA (US) 30327

( * ) Notice: Subject to any disclaimer, the term of this patent is extended or adjusted under 35 U.S.C. 154(b) by 214 days.

(21) Appl. No.: 10/106,496

(22) Filed: Mar. 27, 2002

(65) Prior Publication Data

US 2003/0183240 A1 Oct. 2, 2003

(51) Int. Cl.
*A45D 33/00* (2006.01)
*B65D 81/02* (2006.01)

(52) U.S. Cl. ..... 132/294; 206/521; 220/592.2

(58) Field of Classification Search ..... 132/293, 132/294, 295, 304, 305, 314, 315; 206/235, 206/823, 581, 521, 522, 623, 524, 584; 220/560.12, 220/592.2, 592.23, 632, 920
See application file for complete search history.

(56) References Cited

U.S. PATENT DOCUMENTS

| | | | | |
|---|---|---|---|---|
| 1,233,074 | A | 4/1917 | Kantrowitz | |
| 1,286,139 | A | 11/1918 | Stealey | |
| 1,345,360 | A | 7/1920 | Goertz et al. | |
| 1,427,040 | A | 8/1922 | Weiner | |
| 1,443,542 | A | 1/1923 | Kollstede | |
| 1,512,005 | A | 10/1924 | Wright | |
| 1,517,662 | A | 12/1924 | Wilson | |
| 2,163,429 | A | 6/1939 | Kaplan et al. | |
| 2,215,480 | A | 9/1940 | Sampson | |
| 2,315,647 | A | 4/1943 | Nyden | |
| 2,362,120 | A | 11/1944 | Swart | |
| 2,368,687 | A | 2/1945 | Stanley | |
| 2,424,817 | A | 7/1947 | Grassi | |
| 2,527,169 | A | 10/1950 | Wiggins | |
| 2,734,517 | A | 2/1956 | Ferraro | |
| 3,441,033 | A | 4/1969 | Flax | |
| 3,442,414 | A | 5/1969 | Pelli | |
| 3,871,521 | A * | 3/1975 | Szatkowski | 206/524 |
| 4,018,237 | A | 4/1977 | Steiman | |
| 4,085,785 | A * | 4/1978 | Hoot | 220/592.24 |
| 4,243,765 | A * | 1/1981 | Keskkula et al. | 525/86 |
| 4,333,128 | A | 6/1982 | Moore | |
| 4,404,296 | A * | 9/1983 | Schapel | 523/105 |
| 4,461,332 | A * | 7/1984 | Parkhurst | 150/112 |
| 4,589,430 | A | 5/1986 | Sussman | |
| 4,685,558 | A | 8/1987 | Filiz et al. | |
| 4,781,288 | A | 11/1988 | Wing | |
| 4,826,014 | A | 5/1989 | Schefer | |

(Continued)

FOREIGN PATENT DOCUMENTS

DE 1 105 560 4/1961

(Continued)

*Primary Examiner*—Corrine McDermott
*Assistant Examiner*—David Comstock

(57) ABSTRACT

A protected cosmetic container includes a base and a lid removably associated with the base to obtain closed and open positions. The lid and/or base include an interior face and an exterior face connected to the interior face to define a cavity supplied with a shock absorbing body of material and/or a thermally resistant insulant. The lid and/or base may alternatively be made entirely or substantially entirely as a body of non-cellular shock absorbing material and/or a body of thermally resistant insulant, or may be constructed as a shock absorbing material and/or a thermally resistant insulant encased between interior and exterior faces. The protective shield includes a shield lid and a shield base having recesses therein for mounting the lid and base, respectively, of an industry-standard cosmetic container, with at least one of the shield lid or shield base being deformable and/or thermally resistant.

63 Claims, 10 Drawing Sheets

U.S. PATENT DOCUMENTS 4,989,419 A * 2/1991 Brando et al. ..... 62/457.2
5,005,697 A 4/1991 Jimbo et al.
5,092,354 A 3/1992 Pacelli, Jr.
5,107,871 A 4/1992 Butcher et al.
5,135,012 A 8/1992 Kamen et al.
5,323,794 A 6/1994 Favre
5,373,862 A 12/1994 Blachut
5,520,202 A 5/1996 Arbree
5,562,228 A * 10/1996 Ericson ..... 62/457.2
5,638,839 A * 6/1997 Montoli ..... 132/295
5,655,553 A 8/1997 Giese et al.
5,682,910 A 11/1997 Kizawa et al.
5,713,471 A 2/1998 Gueret
5,735,297 A 4/1998 Litton
5,842,486 A * 12/1998 Davis et al. ..... 132/295
5,875,795 A 3/1999 Bouix
5,896,866 A 4/1999 Quennessen
5,908,037 A 6/1999 Pierson
5,992,427 A 11/1999 Playe
6,055,992 A 5/2000 Skarne
6,123,198 A * 9/2000 Pflueger et al. ..... 206/581
6,223,754 B1 * 5/2001 Burdi et al. ..... 132/300
6,234,340 B1 * 5/2001 Bannister ..... 220/592.2
6,265,665 B1 * 7/2001 Zahnen ..... 174/92
6,478,569 B1 * 11/2002 Masterson et al. ..... 425/503
6,640,813 B1 * 11/2003 Raisner et al. ..... 132/200
2003/0019502 A1 * 1/2003 Terzian ..... 132/294
2004/0097650 A1 * 5/2004 Ogawa et al. ..... 525/98

FOREIGN PATENT DOCUMENTS

DE 41 41 249 A1 6/1993
EP 0 081 901 A2 10/1982

* cited by examiner

PROTECTED CONTAINERS

BACKGROUND OF THE INVENTION

1. Field of the Invention

The present invention relates generally to cosmetic containers and, more particularly, to protected cosmetic containers having shock absorption to protect against damage from shocks and/or having thermal resistance to protect against the effects of heat and to protective shields for standard cosmetic containers.

2. Description of the Related Art

Hinged cosmetic containers such as compacts are commonly used to hold various cosmetics or make-up including face powder, blush, eye shadow, lip color, and the like. Indeed, virtually every type of make-up can be provided in a form suitable for being contained in a cosmetic compact. It is also typical for a cosmetic compact to hold accessories, such as various applicators for the cosmetics contained therein and/or mirrors. Cosmetic compacts allow one or more cosmetics in quantities sufficient for multiple applications to be conveniently stored and/or transported, particularly in receptacles such as cosmetic carriers, handbags or purses, for access and use on demand. Accordingly, cosmetic compacts are very prevalent and highly popular.

Conventional cosmetic compacts typically include a housing or shell having a lid pivotally mounted to a base for movement between closed and open positions, and one or more cosmetics contained in the interior of the base. The housings of conventional cosmetic compacts are ordinarily made of substantially rigid or brittle materials, such as plastics and/or metals. Since it is not unusual for cosmetic compacts to be subjected to shocks, such as impacts, vibrations or jarring forces, during use, storage and/or transport, the housings and/or the contents thereof often sustain irreparable damage. The housings themselves may crack or break, mirrors within the housings may crack or shatter, and/or cosmetics within the housings may crack, fracture, chip or crumble. Cosmetics may leak out of damaged housings, and damaged cosmetics may leak out of even intact housings. Leakage of contents from the housings of cosmetic compacts results in loss of potentially expensive cosmetics and may adversely compromise surrounding objects or areas. For example, cosmetics leaked from housings onto surrounding objects or areas may necessitate tedious cleaning of the objects or areas and may permanently stain the objects or areas. Damaged cosmetics may no longer function as desired and are particularly vulnerable to further degradation. Accordingly, damaged cosmetic compacts may no longer provide sufficient protection for their contents and may become unsuitable for normal use, storage and/or transport. Damaged cosmetic compacts, therefore, are usually disposed of by their users prematurely, thusly resulting in economic loss.

A cosmetic compact having a flexible housing made of a plastic or rubber elastomeric foam to protect against damage from shocks has been proposed in U.S. Pat. No. 6,055,992 to Skarne. A significant drawback to the proposed cosmetic compact is that the flexible housing must rely for dimensional stability upon a dimensionally sturdy mirror and a dimensionally sturdy cosmetic compartment or tray disposed in the lid and base, respectively, of the housing. The dimensional instability of the housing when the mirror and/or the cosmetic compartment are not installed therein renders the compact unsuitable for use when some of the contents are removed. This is undesirable, especially in a cosmetic compact having a plurality of removable cosmetic trays respectively containing cosmetics which a user may deplete at different rates. The user may, for example, wish to remove some or all of the cosmetic trays, such as those which are empty or substantially depleted, from the housing and continue to use the cosmetic compact for any remaining cosmetics and/or for the mirror or other accessories. This cannot be done with the compact proposed by Skarne since the housing becomes dimensionally unstable and uncontrollably flexible when contents are removed and the compact is handled during normal use. The cosmetic compact proposed by Skarne fails to provide the versatility needed to enable users to remove some of the contents and continue using the cosmetic compact in a normal manner. Another significant drawback to the cosmetic compact proposed by Skarne is that the elastomeric foam may be easily gouged, scratched, slashed or penetrated by other objects during routine use, thereby detracting from its shock absorbing effectiveness as well as from its appearance. In addition, the shock absorbing properties of foam are subject to degradation in that the open cells of the foam are susceptible to crushing and permanent collapse so that the foam loses its springiness in a short time when subjected to repeated deformations.

U.S. Pat. No. 5,135,012 to Kamen et al discloses a cosmetic compact in which the lid and base of the housing are flexible due to being made of a piece of thermoplastic material of nominal thickness. The nominal thickness of the lid and base reduces the structural strength of the housing and provides little protection for the contents against damage from shocks.

U.S. Pat. No. 5,682,910 to Kizawa et al discloses a compact having a soft area along a front wall thereof to define a push button for releasing hooks used to maintain the compact in a closed position. The location and design of the soft area make it ineffective for shock absorption.

In addition to hinged cosmetic containers, such as compacts, various types of non-hinged cosmetic containers are conventionally known. For example, cosmetic containers such as jars or pots having a base containing a cosmetic and a separate lid removably associated with the base are marketed and sold by many cosmetic suppliers. The lids may be threaded onto the bases, may be press fit on the bases, may snap on and off of the bases, and/or may be removably associated with the bases in any other manner. Industry-standard cosmetic containers of the non-hinged type are, like industry-standard cosmetic compacts, very advantageous for conveniently transporting and/or storing cosmetics but are typically not protected against shocks and possess the same disadvantages described above for industry-standard cosmetic compacts. However, shock absorbing cosmetic containers of the non-hinged type have thus far not been contemplated. Moreover, no product currently exists by which pre-existing, conventional or industry-standard cosmetic containers of both the hinged and non-hinged types can be shielded to effectively absorb shocks so that the containers themselves as well as their contents are protected from damage, particularly while allowing the cosmetic containers to be used in their normal and intended manners.

Conventional cosmetic containers of the hinged and non-hinged types are made from materials that tend to readily absorb and conduct ambient heat, which often results in thermal damage to the cosmetics within the cosmetic containers. The foam proposed in the Skarne patent is a particularly good thermal conductor since external heat can easily penetrate to the compact interior via the open cells of the foam. When conventional cosmetic containers are exposed to heat, cosmetics contained therein are typically undesirably altered. For example, the consistency of the cosmetics may be detrimentally changed in that the cosmetics may soften and may even melt, liquify or "run". Cosmetics that have experienced thermal damage may be rendered temporarily unsuitable for use and, in many cases, may be rendered permanently unsuitable for use. Even where thermally damaged cosmetics are suitable for further use, the cosmetics often times remain impaired in one or more ways. Since cosmetic containers are commonly transported in receptacles which are often placed in hot vehicles, sunny locations and other environments where the receptacles and, therefore, the cosmetic containers, may be exposed to damaging heat, thermal effects to cosmetics occurs with unwanted frequency. Given that many cosmetics are expensive, thermal damage to cosmetics represents a significant economic loss. Unfortunately, conventional cosmetic containers have not been designed with a view toward protecting the cosmetics therein from thermal damage, and no product currently exists by which pre-existing, conventional or industry-standard cosmetic containers may be shielded to protect against thermal effects.

From the foregoing, it can be seen that a need exists for cosmetic containers which are better protected to absorb shocks and that a need also exists for cosmetic containers in which the cosmetics can be protected from thermal damage. In addition, there is also a need for protective shields for receiving pre-existing, industry-standard cosmetic containers to provide shock absorption and/or thermal protection for the cosmetic containers.

SUMMARY OF THE INVENTION

Accordingly, it is a primary object of the present invention to overcome the aforementioned disadvantages of prior art cosmetic containers.

Another object of the present invention is to supply a thermally resistant insulant and/or a material forming a shock absorbing body of material to cavities defined between interior and exterior faces of the lid and/or base of a cosmetic container and further to supply the thermally resistant insulant and/or the material to the cavities from externally thereof.

It is also an object of the present invention to supply a selected volume of a thermally resistant insulant and/or a material forming a shock absorbing body of material to cavities defined in the lid and/or base of a cosmetic container in accordance with a desired external geometric configuration, a desired level of shock absorption protection and/or a desired level of thermal protection selected for the cosmetic container.

The present invention has as another object to enhance the durability, shock absorbing effectiveness and visual and tactile aesthetics of shock absorbing cosmetic containers.

A further object of the present invention is to form the lid and/or base of a cosmetic container of a solid, compressible and/or elastomeric non-cellular material for enhanced shock absorption, durability and visual and tactile aesthetics.

Moreover, it is an object of the present invention to form the lid and/or base of a cosmetic container of a thermally resistant insulant to protect a cosmetic within the cosmetic container from thermal damage.

Yet another object of the present invention is to form the lid and/or base of a cosmetic container of a shock absorbing material and/or a thermally resistant insulant encased between interior and exterior members or faces.

An additional object of the present invention is to form the lid and/or base of a cosmetic container of a compressible and/or elastomeric rubber providing both shock absorption protection and independent geometric stability to the cosmetic container.

It is an additional object of the present invention to install an industry-standard cosmetic container in a protective shield to provide shock absorption and/or thermal protection to the cosmetic container.

A still further object of the present invention is to provide protective shields for use as accessories to industry-standard cosmetic containers.

Some of the advantages of the present invention are that the housings of the protected cosmetic containers and the protective shields may themselves be protected against damage due to shocks; the protected cosmetic containers and protective shields are lightweight; cosmetic-related objects including mirrors, accessories and cosmetics can be removably or non-removably mounted in the housings of the protected cosmetic containers; the accessories contained in the protected cosmetic containers can include various applicators; one or a plurality of cosmetics can be contained in the lids and/or bases of the protected cosmetic containers for efficient utilization of space; where hinges a r e used to connect the lids and bases of the housings, the hinges may be formed integrally, unitarily with the lids and bases or as separate mechanical components; reinforced hinges may be used for increased strength; the lids and/or bases may be provided with various exterior finishes providing shock absorption, enhanced visual characteristics, enhanced tactile characteristics, water resistance, thermal protection, improved durability and/or greater ease of use; various materials can be supplied to the cavities of the lids and bases to form the shock absorbing bodies of material; the size of the cavities can be fixed or predetermined or can be varied by supplying more or less material thereto; the level of shock absorption and/or thermal protection can be selected in accordance with the fragility and/or economic value of the contents; various materials can be used for the thermally resistant insulant including fluids, solids and semi-solids; various closures and/or seals can be used in the protected cosmetic containers and/or protective shields; industry-standard cosmetic containers can be removably or non-removably installed in the protective shields; the industry-standard cosmetic containers can be secured in the protective shields with or without the use of separate securing devices; an individual protective shield may be designed to accept both hinged and non-hinged industry-standard cosmetic containers; and an individual protective shield may be designed to accept industry-standard cosmetic containers of various configurations and/or sizes.

These and other objects, advantages and benefits are realized with the present invention, one representative embodiment of which is generally characterized in a protected cosmetic container including a base and a lid removably associated with the base to obtain closed and open positions. The lid has an interior lid face and an exterior lid face connected to the interior lid face so as to define a lid cavity. The base has an interior base face and an exterior base face connected to the interior base face so as to define a base cavity. The lid and base cavities each contain a shock absorbing body of material and/or a thermally resistant insulant supplied to the cavities from externally thereof. Either or both of the interior lid and base faces have one or more wells formed therein for receiving one or more cosmetics. The lid and base cavities may be distensible, allowing a variable volume of material and/or insulant to be supplied to the lid and base cavities in accordance with preselected external geometric configurations for the lid and base, a preselected level of shock absorption protection for the cosmetic container and/or a preselected level of thermal protection for the cosmetic container.

An alternative representative embodiment of a protected cosmetic container is generally characterized by a base and a lid removably associated with the base to obtain closed and open positions, wherein the lid and base are made in their entireties or substantially in their entireties of a solid non-cellular material for absorbing shocks and/or resisting thermal conduction. The non-cellular material for the lid and base may be provided without external and internal coverings such that the lid and base are each made entirely of the non-cellular material. Where the lid and/or base is provided with an external and/or internal covering, it may be considered as being substantially entirely made of the non-cellular material.

A further representative embodiment of a protected cosmetic container is generally characterized by a base and a lid removably associated with the base to obtain closed and open positions, wherein the lid and base are made in their entireties or substantially in their entireties of a coldness retaining material.

Another representative embodiment of a protected cosmetic container is generally characterized by a base and a lid removably associated with the base to obtain closed and open positions, wherein the lid and base are made in their entireties or substantially in their entireties of a compressible and/or elastomeric solid rubber for absorbing shocks. The rubber lid and base have predetermined geometric configurations, and the rubber is of sufficient rigidity to independently maintain the predetermined geometric configurations.

An additional and particularly preferred representative embodiment of a protected cosmetic container is generally characterized by a base and a lid removably associated with the base to obtain closed and open positions, wherein the lid and base each comprise a shock absorbing material and/or a thermally resistant insulant encased between interior and exterior faces. In this embodiment, the base and lid will typically be made substantially in their entireties of the shock absorbing material and/or thermally resistant insulant.

Yet another representative embodiment of a protected cosmetic container is generally characterized by a first housing member and a second housing member removably engageable with one another to obtain closed and open positions. At least one of the first and second housing members contains a cosmetic and comprises a shock absorbing material, a shock absorbing body of material and/or a thermally resistant insulant. The first and second housing members may be removably engageable via a press fit, a snap fit, a friction fit, a threaded engagement or in any other manner. The first and second housing members may be connected by a hinge or any other connecting structure. The at least one housing member may comprise an interior face and an exterior face connected to the interior face to define a cavity for being supplied with a thermally resistant insulant and/or a material forming a shock absorbing body of material from externally of the at least one housing member. Alternatively, the at least one housing member may be made in its entirety or substantially in its entirety of a solid, non-cellular shock absorbing material. As another alternative, the at least one housing member may be made in its entirety or substantially in its entirety of a compressible and/or elastomeric solid rubber of sufficient rigidity to independently maintain a predetermined geometric configuration for the at least one housing member. As an additional alternative, the at least one housing member may comprise a shock absorbing material and/or a thermally resistant insulant encased between interior and exterior faces.

A protective shield according to the present invention is generally characterized in a shield lid and a shield base having interior faces, respectively, defining respective lid and base recesses. The lid and base recesses are adapted to receive the lid and base, respectively, of an industry-standard cosmetic container. The shield lid and shield base may be made partly or entirely of a shock absorbing material, a shock absorbing body of material and/or a thermally resistant insulant to protect the industry-standard cosmetic container from shocks and/or thermal effects while allowing the industry-standard cosmetic container to be used in a normal manner while maintained in the shield. The shield lid and the shield base may have exterior faces connected to their interior faces to define lid and base cavities, respectively, containing a shock absorbing body of material and/or a thermally resistant insulant supplied to the cavities from externally thereof. The shield lid and shield base may alternatively be made in their entireties or substantially in their entireties of a thermally resistant insulant and/or a shock absorbing material. The shield lid and shield base may each include a thermally resistant insulant and/or a shock absorbing material encased between interior and exterior faces.

A protected industry-standard cosmetic container assembly is generally characterized in a protective shield including a shield lid and a shield base having interior faces, respectively, defining respective lid and base recesses, and an industry-standard cosmetic container having a lid and a base installed in the lid and base recesses, respectively, for shock absorption and/or thermal protection.

DESCRIPTION OF THE PREFERRED EMBODIMENTS

Figure 1:
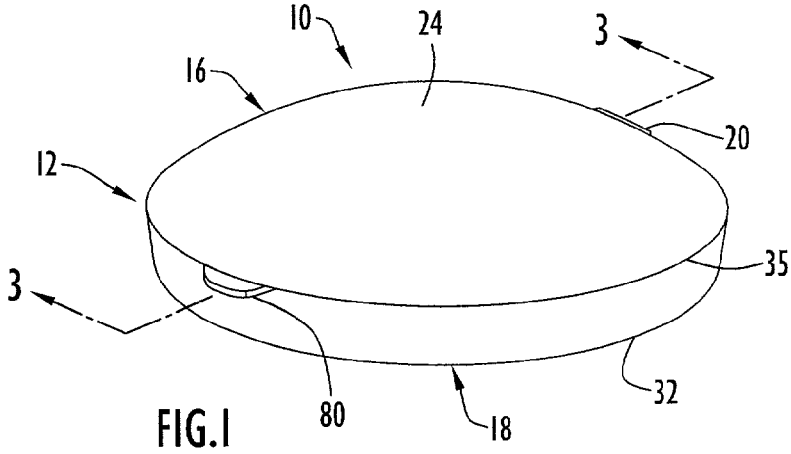
FIG. 1 is a perspective view of a protected cosmetic container according to the present invention in a closed position.
Figure 2:
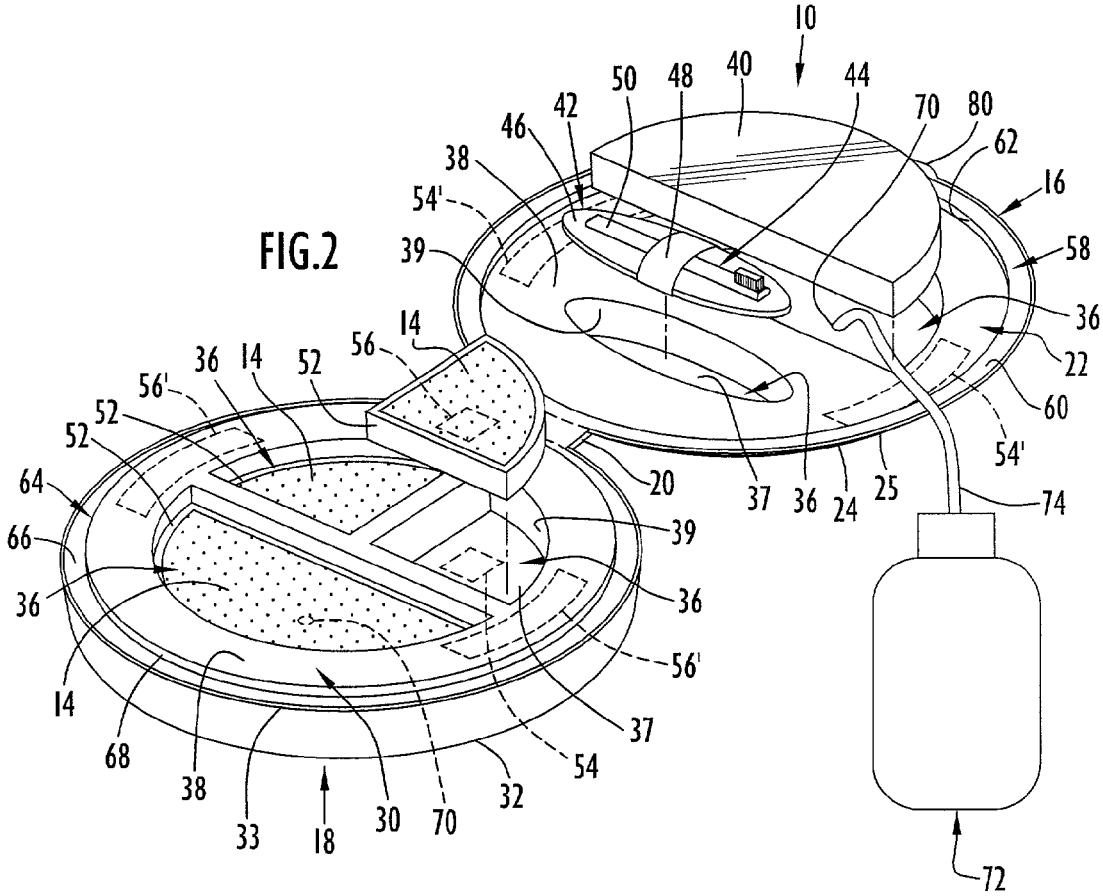
FIG. 2 is a partially exploded perspective view of the protected cosmetic container in an open position.
Figure 3:
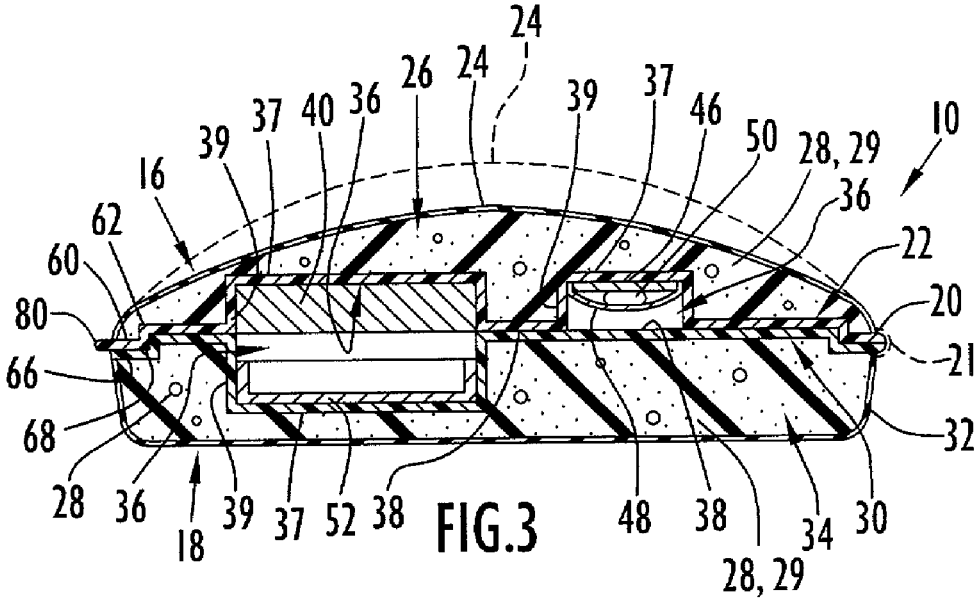
FIG. 3 is a side sectional view of the protected cosmetic container taken along line 3—3 of FIG. 1.

A protected cosmetic container 10 according to the present invention is illustrated in FIGS. 1–3 as a hinged cosmetic container or compact including a housing or shell 12 and one or more cosmetic-related items, objects or contents contained in housing 12. Housing 12 includes a first housing member or lid 16, a second housing member or base 18 and a hinge 20 pivotally connecting lid 16 to base 18 for movement between a closed position shown in FIGS. 1 and 3 and an open position shown in FIG. 2. Lid 16 includes an interior lid face, member or wall 22 and an exterior lid face, member or wall 24 having peripheral or perimetrical edges connected to one another along a seam 25 to define and enclose a lid cavity 26 between the interior and exterior lid members for being supplied with a quantity of material forming a shock absorbing body of material 28 and/or for being supplied with a thermally resistant insulant 29 as shown in FIG. 3. Base 18 includes an interior base face, member or wall 30 and an exterior base face, member or wall 32 having peripheral or perimetrical edges connected to one another along a seam 33 to define and enclose a base cavity 34 between the interior and exterior base members for being supplied with a quantity of material forming a shock absorbing body of material 28 and/or for being supplied with a thermally resistant insulant 29 as shown in FIG. 3. In the closed position, the interior lid member 22 is disposed over the interior base member 30 in facing relation such that the housing defines an interior that is enclosed and inaccessible. In the open position, the interior lid member 22 is removed from the interior base member 30 and is in non-facing relation therewith such that the interior of the housing is exposed and accessible while the lid remains attached to the base via the hinge.

The peripheral edges of the interior lid and base members can have various configurations in accordance with the configuration desired for the protected cosmetic container including circular, oval, rectangular and square peripheral configurations. The peripheral edges of the interior lid and base members 22 and 30 have a circular configuration in the illustrated embodiment. The seams 25 and 33 are aligned or flush in the closed position to form a smooth, even junction 35 along the exterior of the protected cosmetic container. The interior lid member 22 and the interior base member 30 can be made of the same or different materials, which can be rigid or flexible. As an example, the interior lid and base members are both molded plastic members of greater rigidity than the exterior lid and base members.

As best shown in FIGS. 2 and 3, the interior lid member 22 and the interior base member 30 each preferably define one or more wells 36 in which the cosmetic-related contents, items or objects, including one or more cosmetics 14, mirror 40, applicator 44 and/or various other cosmetic-related items are disposed. However, only one of the first housing member or lid 16 and the second housing member or base 18 need be provided with at least one well 36 for containing a cosmetic 14. The wells 36 have bottom surfaces or walls 37 recessed from interior surfaces 38 of the interior lid and base members, respectively, and have side surfaces or walls 39 joining the bottom surfaces 37 to the interior surfaces 38, which may be planar. The wells 36 are open to the interior of the housing and can have various perimetrical or peripheral configurations and/or various uniform or non-uniform depths in accordance with the dimensions of the items, contents or objects to be disposed therein.

In the illustrated embodiment, the interior lid member 22 includes a well 36 having a semi-circular peripheral configuration for mounting or receiving the semi-circular mirror 40, and a well 36 having a generally oval or elliptical peripheral configuration for mounting or receiving a retainer 42 for the applicator 44. The wells for the interior lid member 22 are arranged symmetrically to a diametric axis of lid 16 bisecting hinge 20, with the oval well disposed between the semi-circular well and the hinge. The interior base member 30 for the illustrated embodiment includes two wells 36 of quarter-circular peripheral configuration and one well 36 of semi-circular peripheral configuration respectively receiving correspondingly configured trays 52 containing the cosmetics 14. The quarter-circular and semi-circular wells of interior base member 30 are arranged within a circular area concentric with the peripheral edge of the interior base member and are arranged symmetrically to a diametric axis of base 18 bisecting hinge 20. The quarter-circular wells are disposed between hinge 20 and the semi-circular well of base member 30, with a quarter-circular well disposed on each side of the diametric axis.

It should be appreciated that the wells and, therefore, the objects to be disposed therein, can be arranged in the lid and base in many various ways and that the interior lid member can be provided with one or more wells for containing cosmetics to maximize efficient use of space. It should be appreciated, however, that the interior lid member 22 can be provided without any wells therein in that no contents need be disposed in the lid 16. In this case, the interior base member 30 is provided with at least one well, and one or more cosmetic-related items, contents or objects, including at least one cosmetic, are contained in the at least one well. Of course, another variation could include at least one cosmetic-related object, including at least one cosmetic, in the lid 16 with there being no contents in the base 18. Preferably, at least one cosmetic 14 is contained in either the lid or the base.

Retainer 42 can be designed in various ways and, in the illustrated embodiment, the retainer 42 includes a support 46 for being disposed in the corresponding oval well and a retaining member 48 for releasably retaining the applicator 44 on the support 46. The support 46 can be designed in various ways and is a flat or planar, die-cut plastic piece in the illustrated embodiment, the die-cut piece having a peripheral size and shape to fit within the corresponding well. The support 46 has an interiorly facing surface upon which applicator 44 is supported, and the interiorly facing surface is recessed from the interior surface 38 of the interior lid member 22 when the retainer 42 is installed in the corresponding well. The interiorly facing surface is recessed a sufficient distance from the interior surface 38 of lid member 22 so that the applicator 44 and retaining member 48 are accommodated in the space defined between the support 46 and the interior surface 38 of interior base member 30 in the closed position as shown in FIG. 3. It should be appreciated that the support 46 does not have to be recessed from the interior surface 38 of the interior lid member 22 in that the support may be provided with a depression for the applicator 44 so that the applicator and retaining member are accommodated between the support and the interior base member in the closed position. Of course, objects disposed in the wells of the interior lid member 22 may protrude interiorly from the interior surface 38 of lid member 22 where appropriate space or spaces is/are provided in the interior base member 30 to accommodate such protrusion when the protected cosmetic container assumes the closed position. The same can be said for objects disposed in the wells of the interior base member 30.

The retaining member 48 can be designed in various ways and, in the illustrated embodiment, the retaining member includes an elastic or stretchable strap secured to the support 46. The retaining member or strap 48 extends along the minor central longitudinal axis of the support 46 and may be secured to the support in various ways. For example, the strap 48 may be secured to the support adhesively, such as by being glued to an exteriorly facing surface of the support 46. The applicator 44 can include various types of applicators suitable for applying cosmetics contained in the protected cosmetic container. The applicator 44 for the illustrated embodiment includes an applicator tip connected to a handle 50 insertable between the strap 48 and the interiorly facing surface of the support 46 as shown in FIGS. 2 and 3. The applicator tip is illustrated as a brush but may be a foam, sponge or any other applicator tip. The strap 48 holds the handle 50 against the interiorly facing surface of insert 46, while being stretchable or extensible to allow a user to remove the handle from retainer 42 for use of applicator 44 and to reinsert the handle between the strap and the support for storage of the applicator in the protected cosmetic container.

Mirror 40 and retainer 42 may be non-removably or removably mounted in their corresponding wells. The mirror 40 and retainer 42 may be non-removably mounted in various ways, such as with non-releasable securing devices or glue or other adhesives. In the case of protected cosmetic container 10, the mirror 40 and the support 46 are both permanently glued in their corresponding wells. The mirror 40 and the retainer 42 may be removably mounted in their corresponding wells in various ways, including the use of releasable securing devices, such as magnets or Velcro, and/or the use of a compressible and/or elastomeric material as described below. As explained further below, the releasable securing devices may be formed integrally, unitarily with the interior lid member or may comprise separate components.

The trays 52 are made of metal, but may be made of various other materials including plastic. Upper edges of the trays 52 are preferably recessed about 1/16 inch from the interior surface 38 of interior base member 30 when the trays are installed in the corresponding wells of the interior base member. Initially, the trays 52 are filled with cosmetics 14 up to or substantially up to the upper edges of the trays, and the trays being recessed the specified distance from the interior surface 38 of the interior base member 30 promotes confinement of the cosmetics 14 to their corresponding wells during use and prevents contact of the cosmetics with the interior lid member, and/or objects mounted in the interior lid member, in the closed position. Of course, the cosmetics 14 can be supplied directly to the corresponding wells such that the trays can be eliminated.

The trays 52 can be non-removably secured in their corresponding wells as described above for mirror 40 and retainer 42, but are preferably removably secured in their corresponding wells so that empty or sufficiently depleted trays can be removed by the user and, if desired, replaced with new trays containing a full supply of cosmetics. The trays 52 can be removably secured in their respective wells in various ways including the use of various releasable securing devices formed integrally, unitarily with the interior base member, comprising separate components such as magnets or Velcro and/or comprising a compressible and/or elastomeric material as described further below.

As shown in dotted lines in FIG. 2, the wells 36 corresponding to trays 52 may have releasable securing devices in the form of magnets 54 mounted therein attractive to the metal of trays 52. Magnets 54 can be mounted in various ways, such as being glued into pockets or depressions formed in the bottom surfaces 37 of the wells. Where the trays 52 are not themselves made of a magnetically attractable material, the trays may have cooperating releasable securing devices in the form of magnetically attractable material 56 glued or otherwise secured thereto as shown in dotted lines in FIG. 2. FIG. 2 shows magnetically attractable material 56 secured to the bottom of a tray at a location corresponding to magnet 54. Of course, the location of the magnets and the magnetically attractable material can be reversed in that the trays 52 can be formed of a magnetic material or have magnetic material secured thereto attractive to magnetically attractable material disposed in the corresponding wells.

Trays 52 can contain the same type or different types of cosmetics 14. For example, all of the trays 52 can contain eye shadow, and each tray 52 can contain an eye shadow of a different color. As another example, the trays 52 can contain different types of cosmetics, such as eye shadow, blush and lip color, respectively. The cosmetics 14 can include face powder, foundation, bronzer, blush, lip color, lip gloss, lip balm, eye shadow, eyebrow color, and eye liner, and may be in any suitable form including but not limited to pressed or cake powder, loose powder, gels and/or creams.

An annular rim 58 extends along the periphery of interior lid member 22 and protrudes interiorly from the interior surface 38 of interior lid member 22. The rim 58 has an end surface 60, which may be planar, extending inwardly from the peripheral edge of the interior lid member 22 to an inner side wall 62. Side wall 62 is concentric with the peripheral edge of the interior lid member 22 and extends exteriorly from the end surface 60 to the interior surface 38 of interior lid member 22. Accordingly, the interior surface 38 of lid member 22 is recessed from the end surface 60. A corresponding shoulder 64 follows the periphery of interior base member 30. Shoulder 64 includes an end surface 66, which may be planar, extending inwardly from the peripheral edge of the interior base member 30 to an outer side wall 68, which extends interiorly from end surface 66 to the interior surface 38 of the interior base member 30. The side wall 68 is concentric with the peripheral edge of the interior base member 30, and the end surface 66 is recessed from the interior surface 38 of interior base member 30.

When the protected cosmetic container 10 is in the closed position as shown in FIG. 3, the lid 16 is pivoted toward the base 18, and the inner side wall 62 of rim 58 frictionally engages the outer side wall 68 of shoulder 64 with a press-type fit. The interior lid and base members 22 and 30 are in facing relation, with the inner and outer side walls 62 and 68 engaging in a concentric friction fit that is sufficiently tight that the lid is retained in the closed position and the interior of the housing is enclosed so that the contents are not accessible or exposed. Accordingly, the rim and shoulder form a releasable closure for the protected cosmetic container, the closure serving to releasably or removably engage the lid and base to maintain the closed position. The lid 16 remains in the closed position until a manual opening force, sufficient to overcome the frictional retaining force of the side walls 62 and 68, is applied thereto in order to remove the lid 16 from the base 18. In the closed position, the end surfaces 60 and 66 are in sealing engagement such that the rim and shoulder also form a seal for the protected cosmetic container. The end surfaces 60 and 66 are preferably in continuous contact or abutment, such that the seal provided by side walls 62 and 68 may, but does not have to be, air-tight.

It should be appreciated that the protected cosmetic container can be releasably retained in the closed position and/or that the interior of the housing can be sealed in the closed position in various ways other than or in addition to the rim and shoulder described and shown herein by way of example. Various closures and/or seals can be provided in or on the protected cosmetic container 10 as separate or integral components. As an example, magnets can be used as releasable closures to releasably or removably retain or to assist in retaining the lid in the closed position. FIG. 2 illustrates in dotted lines releasable closures comprising magnets 54' on lid 16 and magnetically attractable material 56' on base 18 at locations corresponding to magnets 54'. The use of magnets and magnetically attractable material as closures for the protected cosmetic containers and protective shields according to the present invention is discussed below in greater detail.

Protected cosmetic container 10 can be designed as a non-hinged protected cosmetic container not having the hinge 20 so that the lid 16 and the base 18 are separate, disconnected parts as shown in dotted lines in FIG. 2 and as described for protected cosmetic container 910. In the latter case, the rim and shoulder permit the lid 16 to be selectively engaged with and removed from the base 18 to obtain the closed and open positions, although the lid 16 can be removably associated with the base 18 using various releasable closures such as threads, for example. Also, the protected cosmetic container 10 could be constructed as a shaped membrane defining the lid and base cavities as described below for protective shield 411.

Hinge 20 can be designed in various ways and may be formed integrally, unitarily with the lid 16 and base 18 or as one or more separate mechanical components. The hinge 20 allows rotation of lid 16 to obtain the open and closed positions. In the open position, the interior lid member is removed from the interior base member so that the interior lid and base members 22 and 30 are no longer in facing relation, thereby exposing the interior of the housing so that the contents are accessible for use. The hinge 20 preferably provides a substantial range of pivotal movement for lid 16. In the illustrated embodiment, the hinge allows the lid 16 to be oriented at 180 degrees to the base 18 in the open position. Accordingly, the protected cosmetic container 10 may assume a flat configuration in the open position, allowing the open protected cosmetic container to be supported on a flat support surface with the exterior lid and base members in contact with the support surface. This is advantageous in facilitating use of the cosmetics disposed in the lid and/or base. Particularly, where cosmetics are disposed in the lid 16, use of such cosmetics is facilitated when the lid 16 is supported on the flat support surface. Use of cosmetics disposed in base 18 is also facilitated since the base can be supported on the support surface with the protected cosmetic container open, but without the risk of the protected cosmetic container tipping, so that the user's hands are not needed to support or stabilize the protected cosmetic container.

The hinge 20 for the illustrated embodiment is formed integrally, unitarily with the interior lid and base members 22 and 30, and is a living or self-hinge formed as a bendable flap pivotally joining the interior lid and base members. The flap extends between the peripheral edges of the interior lid and base members, and may be of desired length, width and thickness. Where an integral, unitary hinge is utilized, it may be advantageous to utilize a sufficiently rigid material for the interior lid and base members so that the hinge is of sufficient structural integrity and strength. Alternatively and/or in addition, the flap may be made of increased thickness or may be covered exteriorly and/or interiorly with a layer of reinforcing material for increased strength and structural reinforcement. It should be appreciated that the hinge 20 could be formed integrally, unitarily with the exterior lid and base members 24 and 32, with reinforcement for the hinge provided as needed. The exterior lid and base members 24 and 32 can be used to reinforce the hinge 20. As an example, the exterior lid and base members 24 and 32 may be connected to one another by an exterior flap 21 which may extend over and cover the flap of hinge 20 exteriorly as shown in dotted lines in FIG. 3. The exterior flap 21 may be the same length and width as the flap of hinge 20 and may be secured to the flap of hinge 20 in various ways including adhesives and/or various sealing and bonding techniques. The exterior flap 21 may be useful to reinforce hinge 20, to reduce the number of parts and/or to simplify the manufacturing process.

The lid cavity 26 and the base cavity 34 distend when supplied with the thermally resistant insulant 29 and/or the material forming the shock absorbing bodies of material 28. The exterior lid member 24 and the exterior base member 32 are each formed as a distensible membrane of minimal thickness made from stretchable or non-stretchable material. Where flap 21 is provided, the lid and base membranes may be formed integrally, unitarily as a one-piece member. Where the lid and base members are not connected by flap 21, the lid and base membranes will each ordinarily constitute a single piece or member, but each could be constituted by a plurality of pieces or members. The lid and base membranes are connected to the interior lid and base members 22 and 30, respectively, to enclose cavities 26 and 34, respectively, in the nature of a bladder. The lid and base cavities for the illustrated embodiment are shown as being separate and not interconnected with one another. It should be appreciated, however, that the lid and base cavities can be connected or in communication with one another along hinge 20 in that the exterior lid and base members 24 and 32 can be connected via a flap, such as flap 21, which may be secured along its edges to the flap of hinge 20 so as to define a hinge cavity connecting the lid and base cavities. This hinge cavity can be supplied with the material forming the shock absorbing body of material and/or with the thermally resistant insulant without impeding the ability of the lid to pivot about the hinge.

The exterior lid and base members may be connected to the interior lid and base members, respectively, by any suitable means including adhesives and/or various sealing and bonding techniques. The lid and base membranes can be made from a durable, tear-resistant material and/or can be exteriorly covered with exterior coverings, which may be made of durable, tear-resistant material. An exterior covering can be provided over either or both of the lid and base membranes for aesthetics, such as to impart a distinctive appearance to the cosmetic container, and/or for functionality, such as to provide water or moisture-resistance, shock absorption or cushioning, thermal protection, increased durability and/or a surface particularly conducive to grasping and handling. The exterior coverings can have a translucent, tinted finish or any other decorative finish. Where the lid and base membranes are not provided with exterior coverings, the lid and base membranes can have a translucent, tinted finish or any other decorative finish. The lid and base membranes can be made of various materials; and, as an example, the exterior lid and base members 24 and 30 can each be made from a thin polyurethane membrane. The interior lid and base members 22 and 30 can be made of the same material as the exterior lid and base members; and, accordingly, the interior lid and base members can be membranes made from stretchable or non-stretchable material as described below in connection with protective shield 411. Where the interior lid and base members are of the same material as the exterior lid and base members, the interior lid and base members can be made integrally, unitarily with the exterior lid and base members, respectively, as also described below for protective shield 411. An interior covering can be provided over either or both of the interior lid and base members. Even where exterior and interior coverings are provided for both the lid and base, the lid and base are still comprised substantially entirely of the shock absorbing body of material 28 and/or the thermally resistant insulant 29. Exterior and interior coverings are described further below.

The interior lid and base members 22 and 30 are assembled to the exterior lid and base members 24 and 32, respectively, prior to the material which forms shock absorbing bodies of material 28 and/or the thermally resistant insulant 29 being supplied to the lid and base cavities 26 and 34. In order to supply thermally resistant insulant 29 and/or the material forming the shock absorbing bodies of material 28 to cavities 26 and 34, supply ports 70 are provided in the lid 16 and the base 18, respectively, at any suitable locations. In the illustrated embodiment, a port 70 is located in the bottom surface of a well in each of the interior lid member 22 and the interior base member 30 as shown in FIG. 2. Accordingly, the ports 70 are exposed and accessible prior to installation of objects in the wells, and are covered and not visible after final assembly of the protected cosmetic container 10. In the illustrated embodiment, ports 70 are provided in the wells corresponding to mirror 40 and the semi-circular tray 52, respectively. The ports 70 are exposed and uncovered prior to installation or assembly of the mirror 40 in the lid 16 and the semi-circular tray 52 in the base 18, and are covered by the mirror and the semicircular tray following final assembly of the protected cosmetic container.

It should be appreciated that the ports 70 can be provided in the exterior lid and base members 24 and 32, respectively, can be provided between the exterior and interior lid and base members, for example along seams 25 and 33, respectively, and/or can be provided at any other suitable locations establishing communication with the enclosed cavities 26 and 34, respectively, from the exterior thereof. Ports 70 are preferably no larger than needed to supply the particular thermally resistant insulant 29 and/or the particular material selected for the shock absorbing bodies of material 28 to the lid and base cavities, and preferably the ports are small in size. The ports can be self-sealing or self-closing after the insulant and/or material has been supplied to the lid and base cavities, or may be sealed or closed using separate members, such as plugs. The ports can be sealed or closed by the objects installed in the wells 36. For example, the port 70 in lid 16 can be sealed or closed by the mirror 40 permanently installed over the port in the corresponding well. It should be appreciated that a single port may be sufficient where the lid and base cavities are in communication with one another as in the case of protective shield 411 described below.

The material selected for the shock absorbing bodies of material 28 and/or the thermally resistant insulant 29 is/are supplied to the lid and base cavities 26 and 34 with the ports 70 exposed to provide access thereto. The material selected for the shock absorbing bodies of material 28 and/or the thermally resistant insulant 29 may be supplied to the lid and base cavities from a source 72, and the source 72 may include a nozzle or dispenser 74 for insertion in the ports 70. The material and/or insulant is/are supplied from the source 72 through the ports 70 and into the lid and base cavities, respectively. Of course, the structural components and the manner for supplying the material and/or insulant to the lid and base cavities can vary depending on the characteristics of the material and/or insulant. Since the material and/or insulant is/are supplied through ports 70, it is preferable that the material and/or insulant be capable of being delivered as a flow or stream.

Illustrative, but not limited, materials for the shock absorbing bodies of material 28 include air, gel, foam, rubber, sand, putty, liquid, powder, cotton, feathers, pellets and the like, presenting or forming a compressible and/or elastomeric shock absorbing body or volume in each of the lid 16 and base 18. The lid and base cavities 26 and 34 are supplied with sufficient quantities of the material to protect the contents of the cosmetic container 10 against damage due to shocks including impacts, jarring forces, shaking and vibrations. Since the material forms a compressible and/or elastomeric body or volume in each of the lid 16 and base 18, the lid and base are themselves protected against damage due to shocks. In addition, the shock absorbing bodies of material 28 in the lid and base cavities 26 and 34 cooperate with the distensible exterior lid and base members 24 and 32, respectively, to obtain selected or predetermined external geometric configurations for the lid 16 and base 18, respectively, as described further below.

Thermally resistant insulant 29 resists conduction of ambient heat to the interior of housing 12 and thusly protects the cosmetic container, especially cosmetics 14, from the effects of heat. Thermally resistant insulant 29 may comprise a coldness retaining material or coolant. The coldness retaining material or coolant may be one having a non-cooled or non-chilled state and which is capable of being activated in response to exposure to a cold environment, such as refrigeration, to assume a cooled or chilled state, with the coldness retaining material thereafter remaining in the cooled state for a significant length of time. A preferred coldness retaining material or coolant comprises a silicone gel, particularly a multi-component, very soft, low-viscosity liquid silicone dielectric encapsulant gel having high energy absorbing characteristics. Another preferred coldness retaining material is a fluidic gel including sodium acetate trihydrate as an additive. The gel used for the coldness retaining material may cure to a soft solid after being supplied to the lid and base cavities or may remain fluidic after curing. The gel would typically be expected to remain in a cooled state for up to three hours or more after being activated by refrigeration from the non-cooled state. Since gels are very elastomeric, an elastomeric and/or compressible shock absorbing body of material is presented in each of the lids 16 and base 18. Accordingly, it should be appreciated that the material forming the shock absorbing bodies of material 28 can be a thermally resistant insulant 29 such that the thermally resistant insulant and the material forming the shock absorbing bodies of material can be one and the same. In other words, the material forming the shock absorbing bodies of material 28 can be, but does not have to be, a thermally resistant insulant, and the thermally resistant insulant 29 can be, but does not have to be, a material forming a shock absorbing body of material. It is preferred, however, that the thermally resistant insulant 29 also form shock absorbing bodies of material in the lid and base so that the protected cosmetic container is protected from both shocks and thermal effects. Of course, a thermally resistant insulant and a material forming a shock absorbing body of material can both be independently supplied to the lid and base such that the material and insulant together provide both shock absorption and thermal protection.

Where the protected cosmetic container 10 is provided with a coldness retaining material that is activated by cooling, the protected cosmetic container 10 will typically be placed in a cold environment, such as a refrigerator, in advance of potential exposure of the cosmetic container to relatively high temperatures. For many cosmetics, relatively high temperatures are temperatures above a normal range for room temperature and may range, for example, from 75 degrees Fahrenheit and above. Exposure to relatively high temperatures may occur, for example, due to relatively high air temperature, relatively high humidity and/or direct exposure to a radiant heat source such as sunlight. The protected cosmetic container will normally be left in the refrigerator for a length of time, i.e., a cooling time, sufficient to establish cooling of the coldness retaining material from the non-cooled state to the cooled state. The temperature, i.e. cooling temperature, of the coldness retaining material in the cooled state will preferably be significantly below the normal range for room temperature and may range, for example, from 35 degrees Fahrenheit to 60 degrees Fahrenheit. The protected cosmetic container can be supplied to the user with a recommend cooling time or times, and the cooling time and/or cooling temperature may vary in accordance with the level of thermal protection desired for the protected cosmetic container. The protected cosmetic container could be provided with indicia, such as a visual indicator, which is a first color when the coldness retaining material is in the non-cooled state and which assumes a second color, different from the first color, when the coldness retaining material assumes a predetermined cooling temperature in the cooled state. The protected cosmetic container 10 is removed from the refrigerator upon the cooled state being obtained, and may thereafter be transported from place to place and used in a normal, routine manner. The coldness retaining material retains its coldness for a considerable length of time after removal from the cold environment, typically three hours or more. During this time, the protected cosmetic container 10 can safely be exposed to environments in which relatively high temperatures may be encountered, and the cosmetics 14 are protected from thermal damage due to such relatively high temperatures. The thermally resistant insulant 29 forms a heat-resistant barrier around cosmetics 14 and deters thermal conduction of heat into the interior of housing 12. In addition to the cosmetics 14 being protected against thermal damage due to relatively high temperatures, the overall shelf life of the cosmetics is extended and the quality of the cosmetics is better preserved when the cosmetics are cooled. Accordingly, a protected cosmetic container having a thermally resistant insulant and, in particular, a coldness retaining material, may benefit significantly from being routinely stored in a refrigerator or other cold environment.

Each of the lid 16 and base 18 is constituted substantially in its entirety of the shock absorbing body of material and/or thermally resistant insulant. The quantities of material and/or insulant supplied to the lid and base cavities 26 and 34, respectively, may be the same or different. The shock absorbing bodies of material 28 and/or thermally resistant insulant 29 supplied to the lid and base cavities result in desired uniform or non-uniform cross-sectional wall thicknesses for the lid and base, respectively, the wall thicknesses being sufficient to provide the necessary shock absorption and/or thermal protection. The selected or predetermined external geometric configurations for the lid 16 and base 18 may be the same or different. In the illustrated embodiment, the exterior lid member 24 has a convex or dome-shaped configuration, and the exterior base member 32 defines a substantially flat or planar bottom wall and an annular side wall. Where the exterior lid and base members 24 and 32 are made of non-stretchable material, the wall thicknesses and/or predetermined external geometric configurations are achieved via appropriate shaping or contouring of the exterior lid and base members. Where the exterior lid and base members are made of stretchable material, the wall thicknesses and/or the predetermined external geometric configurations may be achieved via appropriate shaping or contouring of the exterior lid and/or base members, by providing areas of different stretchability in the exterior lid and/or base members and/or by controlling the quantity of material and/or insulant supplied to the lid and base cavities. As shown in dotted lines in FIG. 3, a larger predetermined external geometric configuration and/or greater wall thickness may be obtained for lid 16, where the exterior lid member 24 is stretchable, by supplying a greater quantity of material and/or insulant to the lid cavity 26 so that the exterior lid member 24 stretches a greater amount. The amount of material and/or insulant supplied to the lid and base cavities can be varied in accordance with a selected level of shock absorption and/or thermal protection desired for cosmetic container 10. By making the exterior lid and/or base members of stretchable material, an individual lid and base can obtain various levels of shock absorption and/or thermal protection for the protected cosmetic container and/or various external geometric configurations and/or sizes. Various levels of shock absorption and/or thermal protection may be obtained by varying the wall thicknesses and/or the densities of the shock absorbing bodies of material 28 and/or the thermally resistant insulant 29.

The material used for the shock absorbing bodies of material 28 and/or the thermally resistant insulant 29 can be in a first state while being supplied to the lid and base cavities and can assume a second state, different from the first state, after being supplied to the lid and base cavities. As an example, the material used for the shock absorbing bodies of material 28 may be a polyurethane foam supplied to the lid and base cavities as a flow or stream in a fluidic state and curing, drying or setting to assume a solid state a short time thereafter. A foam material is also illustrative of a material which performs a self-sealing or self-closing function at ports 70, in that the ports 70 are automatically sealed or closed when the foam assumes the solid state. Representative foams include polyurethane, polyethylene, polypropylene, polystyrene, polyether, polyester polyurethane, ethylene propylene diene monomer (EPDM), neoprene, styrene-butadiene copolymer rubber (SBR), nitrile-butadiene copolymer rubber (N BR), ethylene vinyl acetate (EVA), polyvinyl chloride (PVC) and (PVR/NBR). As another example, a thermally resistant insulant 29 comprising a coldness retaining gel may be supplied to the lid and base cavities in a fluidic state and may subsequently cure to assume a soft solid or semi-solid state. Accordingly, the material and/or insulant may be flowable when supplied to the lid and base cavities and may thereafter become unflowable.

Any suitable material can be supplied to the lid and base cavities to form shock absorbing bodies of material capable of compressing and/or elastically or otherwise resiliently deforming to cushion or absorb shocks to which the cosmetic container may be subjected. Virtually any type of material can be used for the shock absorbing bodies of material including solids, fluids, particulates and granular materials. The material itself can be compressible and/or elastic or can be non-compressible and/or non-elastic, in that a shock absorbing or cushioning effect can be obtained from the manner in which the material is arranged in the lid and base cavities. Individual elements of the material which are not themselves compressible and/or elastic can be arranged to form the shock absorbing bodies of material by virtue of their arrangement in the lid and base cavities. It is preferred that the shock absorbing bodies of material 28 are possessed of sufficient elasticity or shape memory to repeatedly assume, spring back or return to their original shape after compressing or deforming to absorb shocks. As pointed out above, the shock absorbing bodies of material can also be a thermally resistant insulant.

Although the protected cosmetic container 10 is illustrated with both the lid 16 and the base 18 comprising a shock absorbing body of material and/or a thermally resistant insulant for optimal shock absorption and/or thermal protection, it should be appreciated that either or both of the lid and the base may comprise a shock absorbing body of material and/or a thermally resistant insulant. Where only one of the first housing member or lid 16 and the second housing member or base 18 contains a cosmetic or other cosmetic-related object to be protected and the other of the first housing member and the second housing member does not contain any cosmetic-related objects requiring protection, the housing member that contains the cosmetic or other object requiring protection may comprise the shock absorbing body of material and/or thermally resistant insulant while the housing member that does not contain a cosmetic-related object requiring protection does not have to comprise a shock absorbing body of material and/or a thermally resistant insulant and may be of generally conventional design as described below for protected cosmetic container 910. The housing member that is of generally conventional design may be provided with a releasable closure cooperating with a releasable closure of the other housing member to releasably engage the first and second housing members to obtain the closed and open positions. Accordingly, although it is desirable for both the first and second housing members to be protected against shock and/or heat, only one housing member, such as the housing member that contains a cosmetic-related object requiring protection, need be designed with shock absorption and/or thermal protection.

Figure 4:
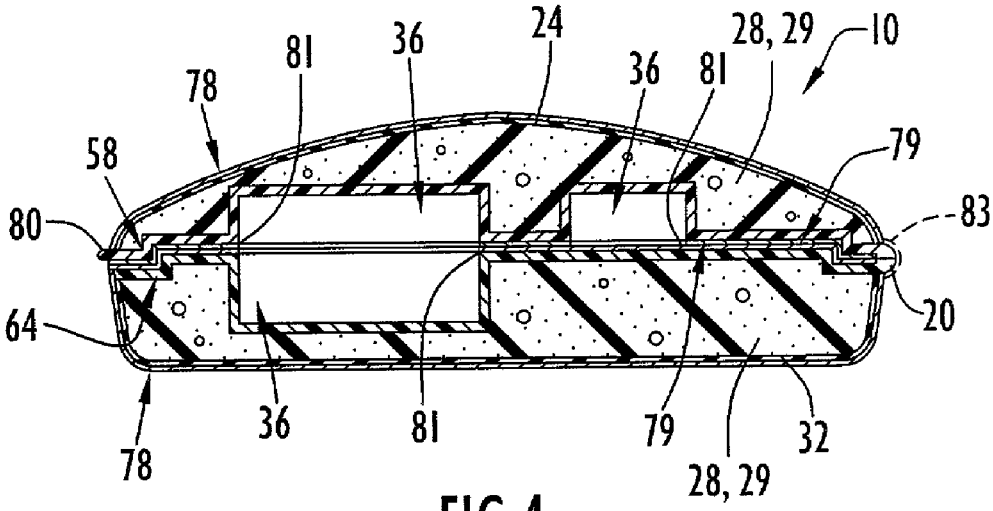
FIG. 4 is a side sectional view of the protected cosmetic container with optional exterior and interior coverings.

FIG. 4 illustrates the protected cosmetic container 10 with optional exterior and interior coverings or skins 78 and 79, respectively, the protected cosmetic container being illustrated in FIG. 4 without the cosmetic-related objects installed in the wells for the sake of simplicity. An exterior covering 78 may be provided over either or both of the exterior lid face and the exterior base face, and FIG. 4 illustrates exterior coverings 78 provided over both the exterior lid member 24 and the exterior base member 32, respectively. The hinge 20 may remain uncovered by exterior coverings 78, or may be covered by exterior coverings 78 as shown in dotted lines at 83. In this instance, the exterior coverings 78 for the lid and base are connected by a connecting flap 83 extending over hinge 20 exteriorly such that the exterior coverings are formed as a one-piece member. It should be understood that the connecting flap of the exterior coverings 78 may thusly be used to impart structural reinforcement to the hinge 20. The exterior coverings 78 are attached to the exterior lid and/or base members, such as by being laminated to the exterior lid and/or base members using adhesives and/or various bonding techniques.

An interior covering 79 may be provided over either or both of the interior lid face and the interior base face. FIG. 4 illustrates interior coverings 79, which are similar to exterior coverings 78, provided over both the interior lid member 22 and the interior base member 30, respectively, except for wells 36. Accordingly, the interior coverings 79 include cut-outs or openings 81 for the wells, the cut-outs 81 each including an edge circumscribing the corresponding well. The interior coverings 79 may extend along the entire or less than the entire interior surface areas of the interior lid member and/or the interior base member. The interior coverings 79 may cover the bottoms and/or sides of the wells as shown for the protected cosmetic container of FIG. 6, and may or may not include cut-outs for the rim 58 and/or shoulder 64. Where magnets 54' and magnetically attractable material 56' are provided as closures, the interior coverings 79 may have cutouts or openings for the closures 54', 56' or any other closures provided in or on the interior lid and base faces. The interior coverings may be connected by a connecting flap extending over the hinge interiorly, and this flap may be used to impart structural reinforcement to the hinge as described above for the connecting flap of the exterior coverings. Accordingly, as described above for the exterior coverings, the interior coverings may also be formed as a one-piece member. The interior coverings 79 are attached to the interior lid and/or base members, such as by being laminated to the interior lid and/or base members.

The exterior and interior coverings or skins 78 and 79 may be made of durable, tear-resistant fabric or film, preferably of minimal thickness. The exterior and interior coverings may be water or moisture-resistant and/or stain-resistant. The exterior and interior coverings may be made of elastic or stretchable material or inelastic or non-stretchable material. Either or both of the exterior and interior coverings may be colored, tinted and/or textured for decorative appearance and/or to facilitate grasping or provide a distinctive feel. Either or both of the exterior and interior coverings may comprise multiple layers of covering, such as multiple layers of fabric or film disposed one on top of the other. The exterior and/or interior coverings may be made of a cushioning or shock absorbing material and/or a thermally resistant insulant, and the thermally resistant insulant may comprise a coldness retaining material. The exterior and/or interior coverings may be made from one or more layers of nylon, vinyl, polyurethane, rubber, such as foam rubber and neoprene, and multi-layer or multi-ply fabrics including open weave, quilted and padded fabrics, for example.

A protruding finger tab 80 may be provided along the periphery of lid 16 diametrically opposite the hinge 20. Finger tab 80 visually and tactilely identifies the optimal location at which the lid 16 may be manually engaged by a finger or fingers of the user for movement of the lid between the closed and open positions. The finger tab 80 may be constructed as part of the interior lid member 22, the exterior lid member 24, the exterior covering 78 for the lid, the interior covering 79 for the lid, and/or as a separate component. In the illustrated embodiment, the finger tab 80 is formed as part of the interior lid member 22. As another example, the finger tab is a separate component inserted and glued between the interior and exterior lid members. Alternatively or in addition to the finger tab, a finger indentation may be provided in base 18 as described below.

Figure 5:
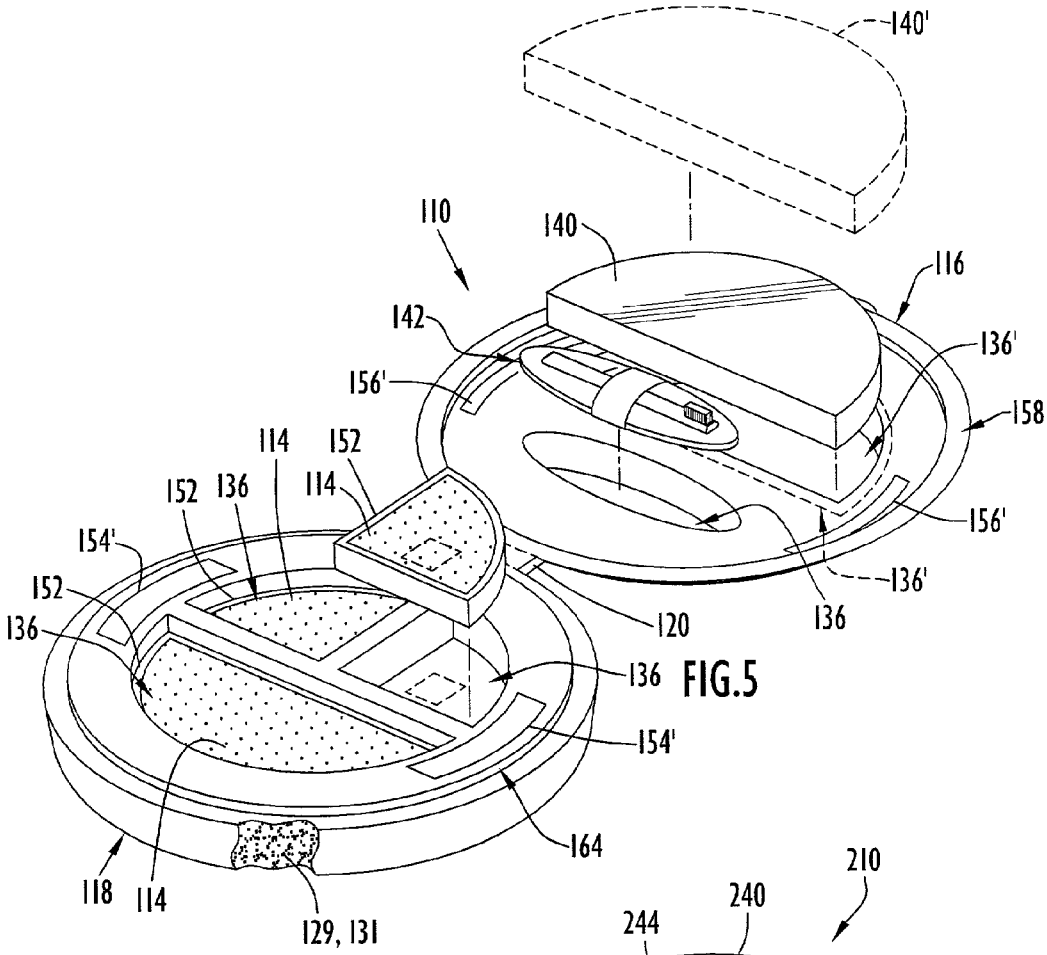
FIG. 5 is a partially exploded perspective view of an alternative protected cosmetic container according to the present invention in an open position.

Another protected cosmetic container according to the present invention is illustrated at 110 in FIG. 5. The protected cosmetic container 110 is illustrated as a hinged cosmetic container or compact but may be designed as a non-hinged cosmetic container, not including a hinge, so that the lid 116 and the base 118 are disconnected parts as shown in dotted lines and as described below for protected cosmetic container 910. The lid 116 and base 118 of protected cosmetic container 110 are made in their entireties as solid or substantially solid bodies, respectively, of a shock absorbing material 131 and/or a thermally resistant insulant 129. Preferably, the solid shock absorbing material is a non-cellular material that is of solid consistency throughout and is devoid of open cells or interstices in its structural composition. In the case of protected cosmetic container 110, the solid bodies of shock absorbing material 131 and the solid bodies of thermally resistant insulant 129 are preferably a non-cellular gel material. However, the solid bodies of shock absorbing material 131 could be made of polyvinyl rubber, vinyl or silicone of non-cellular composition. The gel material used for the solid bodies of shock absorbing material 131 may be, but does not have to be, a thermally resistant insulant. However, since the thermally resistant insulant 129 is made of gel material, it provides protection from shocks as well as heat. Accordingly, solid bodies of gel material can be used to obtain a protected cosmetic container that is protected against shock or that is protected against both shock and heat. It should be appreciated, therefore, that the solid bodies of shock absorbing material 131 and the solid bodies of thermally resistant insulant 129 can be one and the same material.

A typical gel material for protected cosmetic container 110 is a viscoelastic elastomer formulated using long chain polyols and plasticizers, the plasticizers being non-reacting and causing a very soft feel. The plasticizer content is typically very high, to the point of exution. The gel material may be considered a colloid in which the disperse phase is combined with the continuous phase to obtain a non-cellular product ranging from a soft gum drop consistency to a viscous jelly-like consistency. Regardless of consistency, the gel material consistently bounces or springs back to its original shape after being deformed, has high tear strength and impact resistance, and is lightweight. Since the gel material is non-cellular, i.e. without open cells, it does not lose its original elasticity or spring when subjected to repeated deformations caused by shocks. A typical gel material is "self-healing", is resistant to moisture absorption, is moisture insensitive during handling, is non-foaming, does not contain MOCA, MDA or TDI, is easy to use and cures at room temperature. Pigments can be added to the gel material for desired coloration. The gel material may be characterized as having a hardness in the range of 0–55 on the Shore 00 scale to 0–17 on the Shore A scale, but the hardness selected for the gel material may be one step above liquid in consistency. In some cases, the gel material may have a somewhat sticky feel. A representative gel material for the protected cosmetic container 110 includes a two-part or three-part thermoset elastomeric polyurethane gel formed by mixing two or more liquids and then curing the mixture. Illustrative gel materials for the solid bodies of shock absorbing material 131 include Flabbercast curative polyurethane gel, TC-410 A/B-C adjustable hardness soft polyurethane elastomer of BJB Enterprises, Inc. and silicone gel. Illustrative gel materials for the solid bodies of thermally resistant insulant 129 are the gel materials described above for thermally resistant insulant 29. The gel material may be molded or cast, such as by injection molding, to form one piece bodies of shock absorbing material 131 and/or thermally resistant insulant 129. However, the bodies of shock absorbing material and/or thermally resistant insulant could each be cut, shaped or stamped in one piece from a block of the gel material.

Interior faces of lid 116 and base 118, respectively, are formed with wells 136 for receiving mirror 140, retainer 142 and trays 152 containing cosmetics 114 as described above for protected cosmetic container 10. The hinge 120 for protected cosmetic container 110 is similar to hinge 20 and may be reinforced, as necessary, in any suitable manner for increased strength. The protected cosmetic container 110 is sealed in the closed position via rim 158 on lid 116 and shoulder 164 on base 118 as described above. Of course, it should be understood that the rim can be provided on the base and that the shoulder can be provided on the lid in a simple reversal of parts. A pair of magnets 154' are provided in base 116 between the shoulder 164 and the circular area containing trays 152. Magnets 154' are spaced about 180 degrees from each other, with each magnet spaced about 90 degrees from hinge 120. Magnetically attractable material 156' is provided in lid 116 at locations corresponding to magnets 154'. The magnetic attraction between magnets 154' and magnetically attractable material 156' is sufficiently strong to retain the lid 116 in the closed position, and the magnets and magnetically attractable material thusly serve as releasable closures for the protected cosmetic container 110. Where only one of the first housing member or lid 116 and the second housing member or base 118 contains a cosmetic or other cosmetic-related object requiring shock absorption and/or thermal protection, the housing member that contains the cosmetic or other object requiring shock absorption and/or thermal protection may be made of the gel material while the housing member that does not contain any cosmetic-related objects requiring shock absorption and/or thermal protection may be designed without shock absorption and/or thermal protection.

Figure 6:
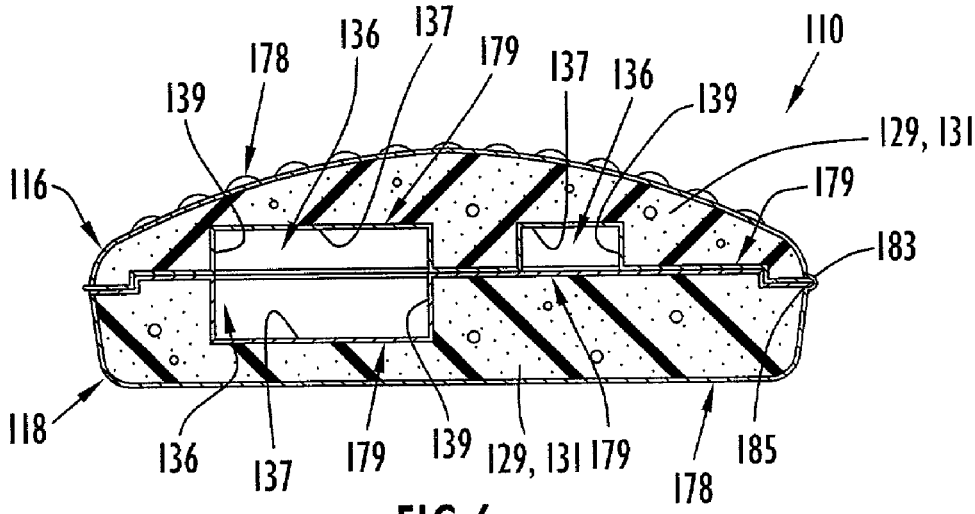
FIG. 6 is a side sectional view of the protected cosmetic container of FIG. 5 in the closed position and illustrating outer and inner coverings.

The protected cosmetic container 110 can be provided with or without exterior and/or interior coverings, which may be the same as the exterior and interior coverings described above. Where the protected cosmetic container 110 is provided without exterior coverings and the gel material has a sticky, adhesive type surface or feel, the bodies of shock absorbing material 131 and/or thermally resistant insulant 129 can be used to promote firm grasping by a user during handling and use of protected cosmetic container 110 and to inhibit displacement of protected cosmetic container 110 from a location at which it is deliberately situated. In this manner, the cosmetic container is less likely to slip from the hands of a user and/or slide off of a surface upon which it is placed. FIG. 6 shows the lid 116 and base 118 of cosmetic container 110 optionally covered on the outside with exterior coverings 178, respectively, and on the inside with interior coverings 179, respectively. The protected cosmetic container 110 is shown in FIG. 6 without the cosmetic-related objects installed in wells 136 for the sake of simplicity. Exterior coverings 178 and interior coverings 179 are similar to exterior and interior coverings 78 and 79, except that exterior coverings 178 are interconnected by connecting flap 183 and interior coverings 179 are also interconnected by a connecting flap 185. The connecting flaps 183 and 185 cover hinge 120 exteriorly and interiorly, respectively, and serve as structural reenforcement for the hinge. Also, the interior coverings 179 do not include cut-outs for wells 136 but, rather, cover the bottom walls 137 and the side walls 139 of the wells. The exterior covering 178 for lid 116 is embossed to provide a decorative appearance and to facilitate grasping.

The lid 116 and base 118 for protected cosmetic container 110 are provided without interior lid and base members, respectively, but can be provided with interior lid and base members, similar to interior lid and base members 22 and 30, as described above for protected cosmetic container 10 and as described below for protected cosmetic containers 610 and 710. Where the protected cosmetic container 110 is provided with interior lid and base members, the lid 116 and the base 118 can still optionally be provided with exterior and/or interior coverings, with the interior coverings disposed over the interior lid and base members as described for interior coverings 79. Where the lid and base of cosmetic container 110 are provided without interior lid and base members and exterior and interior coverings, the lid and base are each made in their entirety of shock absorbing material and/or thermally resistant insulant. Where either the lid or base includes an interior member, an exterior covering and/or an interior covering, it is still made substantially entirely of shock absorbing material and/or thermally resistant insulant.

The gel material from which bodies of shock absorbing material 131 and/or thermally resistant insulant 129 are formed is illustrative of a shock absorbing material and/or a thermally resistant insulant with sufficient elasticity to removably or non-removably retain objects in the wells 136. By way of example, the well 136' corresponding to mirror 140 can be made slightly smaller in peripheral size than mirror 140. When the mirror 140 is installed in well 136', the peripheral size of well 136' is enlarged by the mirror 140, as shown in dotted lines in FIG. 5, due to the elasticity of the shock absorbing material 131 and/or thermally resistant insulant 129 forming lid 116. The elasticity of the shock absorbing material 131 and/or the thermally resistant insulant 129 of lid 116 causes the side walls of well 136' to exert a compressive force on the mirror 140 to removably or non-removably retain the mirror in the well 136'. It should be appreciated, therefore, that the wells of the protected cosmetic containers disclosed herein can be made of compressible and/or elastomeric shock absorbing material and/or compressible and/or elastomeric thermally resistant material, and/or can be lined with compressible and/or elastomeric shock absorbing material and/or compressible and/or elastomeric thermally resistant material capable of retaining cosmetic-related objects in the wells. Representative liners for the wells of the protected cosmetic containers are described further below. Where the shock absorbing material and/or thermally resistant material is used to removably or non-removably retain objects in the wells, extraneous securing devices, such as glue, magnets, Velcro and the like, are not needed but can still be provided for redundant retention. The initial peripheral sizes of the wells and/or the compressibility and/or elasticity of the shock absorbing material and/or the thermally resistant material can be selected to achieve a snug fit or a tight fit between the wells and the objects installed therein, with snug fitting objects being removable from the wells and tight fitting objects being essentially non-removable.

It should also be appreciated that the wells can be made of a compressible and/or elastomeric material and/or can be lined with a compressible and/or elastomeric material of sufficient compressibility and/or elasticity such that an individual well can accommodate objects of various shapes and/or sizes. In the above example for shock absorbing material 131 and thermally resistant insulant 129, well 136' can accommodate either mirror 140 or a mirror 140', shown in dotted lines, having a larger peripheral size than mirror 140. When mirror 140' is installed in well 136', the peripheral size of well 136' is enlarged a greater amount than for mirror 140, as permitted by the deformability and elasticity of shock absorbing of material 131 and/or thermally resistant insulant 129.

Figure 7:
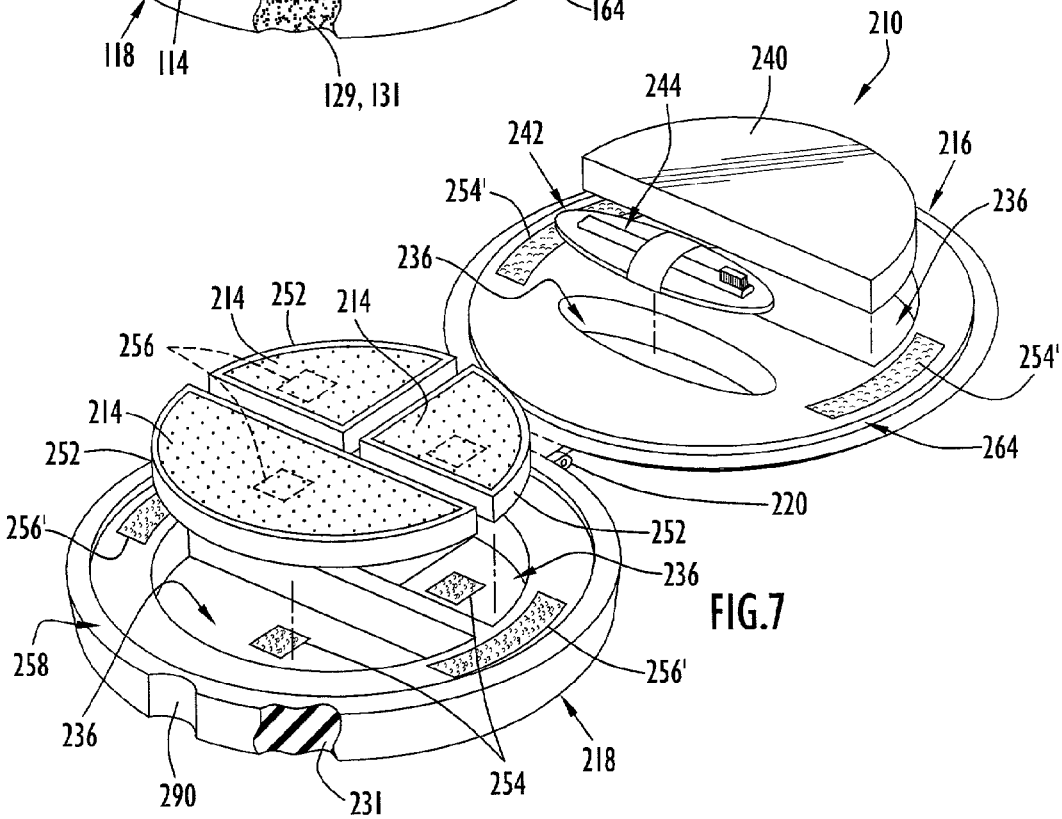
FIG. 7 is an exploded perspective view of another alternative protected cosmetic container according to the present invention in an open position.

An additional protected cosmetic container according to the present invention is illustrated at 210 in FIG. 7. The protected cosmetic container 210 is shown as a hinged cosmetic container or compact; however, the cosmetic container 210 can be designed without hinge 220 to form a non-hinged protected cosmetic container in which the lid 216 and the base 218 are separate, disconnected parts as shown in dotted lines. Protected cosmetic container 210 is similar to protected cosmetic container 110 except that the lid 216 and base 218 for protected cosmetic container 210 are made in their entireties of solid bodies, respectively, of shock absorbing material 231 that is a natural or synthetic compressible and/or elastomeric rubber, such as silicone or polyurethane rubber, of sufficient rigidity so that the lid 216 and the base 218 are independently geometrically stable even when no contents are installed therein as shown in FIG. 7. The lid 216 and the base 218 each have a predetermined geometric configuration, and these predetermined geometric configurations are maintained by the solid bodies of shock absorbing material 231 independently, i.e. without regard to the contents or other extraneous structural components installed in the protected cosmetic container 210, even when the protected cosmetic container 210 is handled during normal use. In other words, the bodies of shock absorbing material 231 are in and of themselves capable of maintaining their predetermined geometric configurations. Although the lid and base are resiliently deformable to absorb shocks, the predetermined geometric configurations are restored and maintained by the solid bodies of shock absorbing material 231 independently and in the absence of extraneous structure.

Interior faces of lid 216 and base 218, respectively, are formed with wells 236 for receiving mirror 240, retainer 242 and trays 252 containing cosmetics 214 as described above for protected cosmetic containers 10 and 110. The hinge 220 for protected cosmetic container 210 is a mechanical hinge including a pin extending through mating lid and base protrusions. The lid and base protrusions can be formed integrally, unitarily with the lid 216 and base 218, respectively, or as separate components attached to the lid and base. The lid and base of the protected cosmetic container 210 are releasably or removably engaged or retained in the closed position, and the interior of the housing is sealed in the closed position via a rim 258 and a shoulder 264. Rim 258 and shoulder 264 are similar to rim 58 and shoulder 64, except that the rim 258 is disposed on base 218 and the shoulder 264 is disposed on lid 216. Cooperatively engageable and releasable Velcro closures 254' and 256' are provided on lid 216 and base 218, respectively, for redundant protection to maintain the lid 216 in the closed position. Cooperatively engageable and releasable Velcro securing devices 254 and 256 are provided on base 218 and trays 252, respectively, to removably secure the trays within the wells 236. Rather than being provided with a finger tab, the protected cosmetic container 210 has a finger indentation 290 along the front of base 218 at a location diametrically opposite the hinge 220. As described above for protected cosmetic containers 10 and 110 and as described below for protected cosmetic container 910, only the housing member that contains a cosmetic or other cosmetic-related object requiring protection need be designed with such protection such that only one of the lid 216 and base 218 need be made as a body of the shock absorbing material 231.

FIG. 7 illustrates the housing for protected cosmetic container 210 in the open position, but without the mirror 240, the retainer 242 and the trays 252 installed therein. When no contents are installed in the housing as shown in FIG. 7, the housing nonetheless independently retains its geometric or dimensional stability, except for the bending that occurs at hinge 220. Although the rubber from which the lid 216 and the base 218 are made provides shock absorption protection for the housing as well as its contents, the housing is still sufficiently rigid and geometrically stable that the protected cosmetic container 210 can be used in a normal, routine manner with some or all of the contents not installed therein.

Where only one of the lid 216 and base 218 is made from shock absorbing material 231, the other of the lid 216 and base 218 can be made of another geometrically stable material. A user can remove any or all of the contents from the lid 216 and/or the base 218 and continue using the protected cosmetic container 210 in a normal, routine manner, since the lid 216 and the base 218 each independently maintain their external geometric configurations. Most typically, a user will remove one or more trays 252 that may be empty or sufficiently depleted of cosmetics 214. Even though replacement trays of cosmetics may not immediately be available to the user, the user can continue using the protected cosmetic container 210 with the one or more trays removed, without the housing uncontrollably flexing or behaving in a manner inconsistent with normal use. Accordingly, the user can continue using the protected cosmetic container 210 for the mirror 240, for the applicator 244, and/or for any remaining trays 252 containing a sufficient quantity of cosmetics. The rubber shock absorbing material 231 is further representative of a shock absorbing material that may itself be used to retain objects in wells 236 and/or to accommodate different sized and/or shaped objects in wells 236, as described above for protected cosmetic container 110.

Although the lid 216 and base 218 for protected cosmetic container 210 are shown without interior lid and base members, respectively, such that the lid and base are each made in their entirety of shock absorbing material 231 it should be appreciated that the lid 216 and base 218 can be provided with interior lid and base members, similar to interior lid and base members 22 and 30, as described above for protected cosmetic container 10 and as explained below for protected cosmetic containers 610 and 710. Regardless of whether or not the lid 216 and base 218 are provided with interior lid and base members, the lid 216 and base 218 may be provided with exterior and/or interior coverings as described above. Where either the lid 216 or base 218 has an interior member, an interior covering and/or an exterior covering, it is still made substantially entirely of the shock absorbing material 231.

Figure 8:
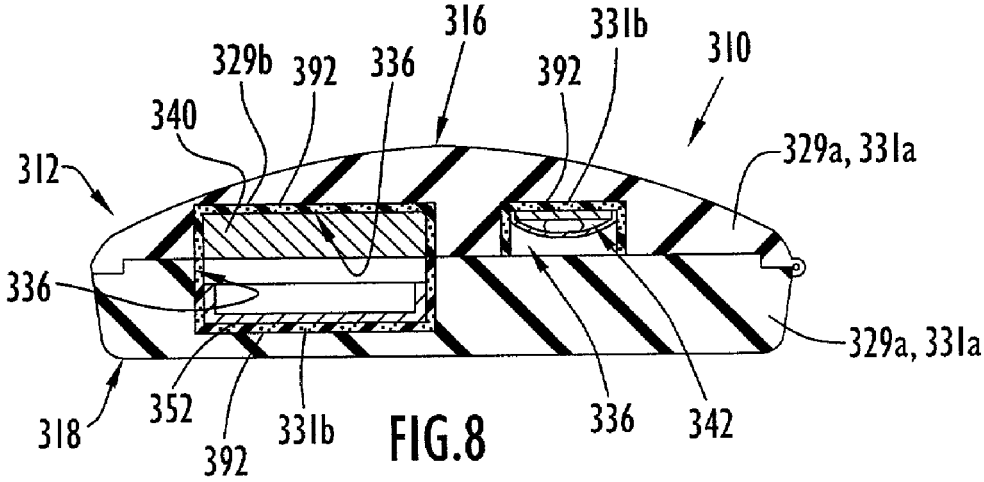
FIG. 8 is a side sectional view of a further alternative protected cosmetic container according to the present invention.

A further alternative protected cosmetic container according to the present invention is illustrated at 310 in FIG. 8. Protected cosmetic container 310 includes lid 316 and base 318 formed entirely or substantially entirely from a first material which is a shock absorbing material 331*a* and/or thermally resistant insulant 329*a*; however, the lid 316 and base 318 could define cavities supplied with thermally resistant insulant and/or a material forming shock absorbing bodies of material as described for protected cosmetic container 10. Protected cosmetic container 310 is similar to the protected cosmetic containers as previously described except that wells 336 for protected cosmetic container 310 have attached linings made from a second material which is a compressible and/or elastomeric material the same as or different from the first material. The second material is shown as a shock absorbing material 331*b*, the material 331*b* being different than the material 331*a* and/or insulant 329*a*. For example, the shock absorbing material 331*a* can be the same as shock absorbing material 231 to provide independent dimensional stability to the housing 312, while the shock absorbing material 331*b* can be of greater elasticity and/or compressibility than shock absorbing material 331*a* to provide an increased cushioning effect around the objects 340, 342 and 352 installed in the wells 336. The second material is provided in the form of a liner 392 for each well 336. Each liner 392 has a bottom wall and/or one or more side walls of suitable thickness covering the bottom and/or side walls of the corresponding wells 336. By selecting the appropriate thickness, compressibility and/or elasticity for the liners 392, the wells 336 can be adapted to removably or non-removably retain the objects in wells 336 and/or accommodate objects of various sizes and/or shapes in wells 336 as described above. The liners 392 can be permanently or removably installed in the wells. The liners 392 may thusly be used for cushioning objects installed in the wells, for removably or non-removably retaining objects in the wells and/or for adapting the wells to accommodate objects of various sizes and/or shapes.

Figure 9:
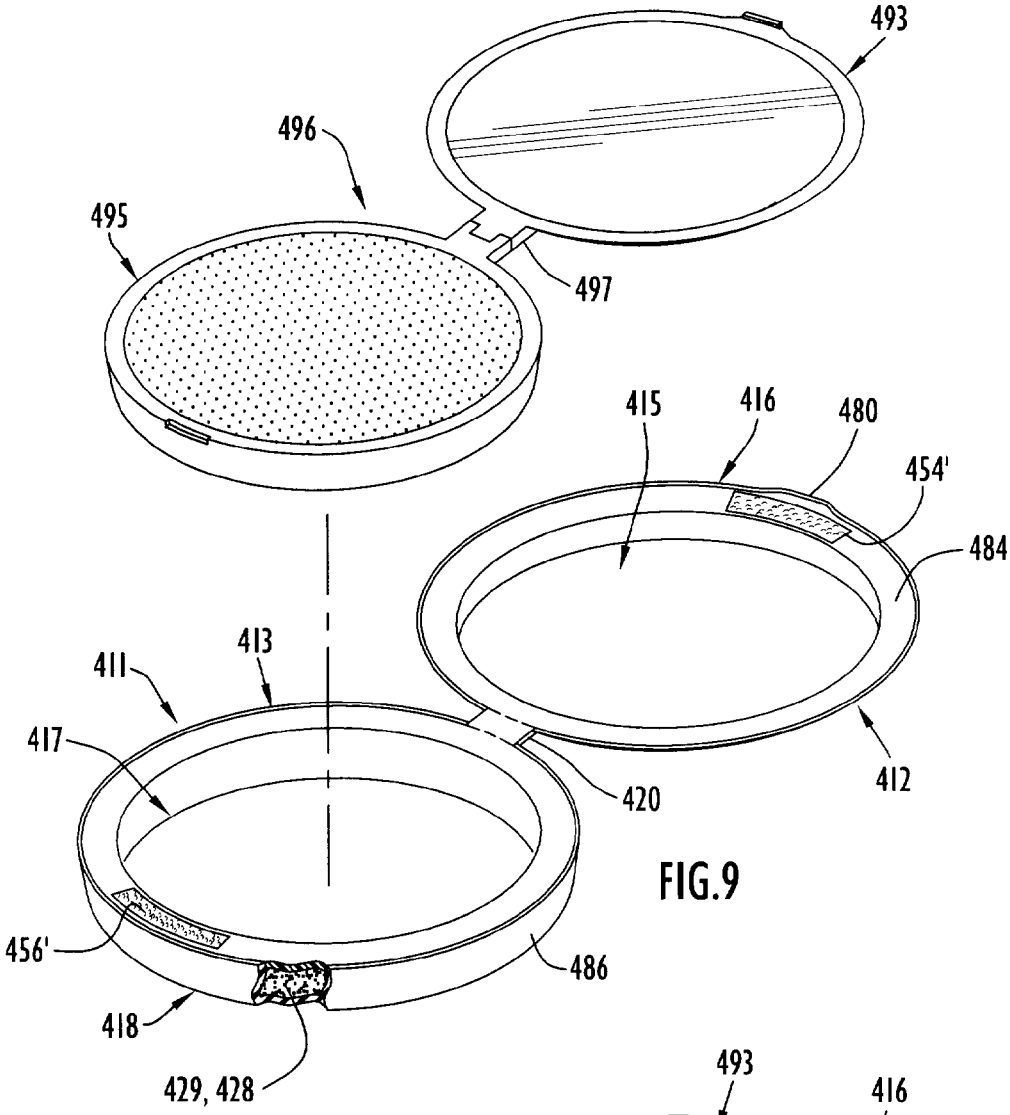
FIG. 9 is a perspective view of a protective shield according to the present invention in an open position and a hinged industry-standard cosmetic container for being installed in the protective shield to form a protected industry-standard cosmetic container assembly.
Figure 10:
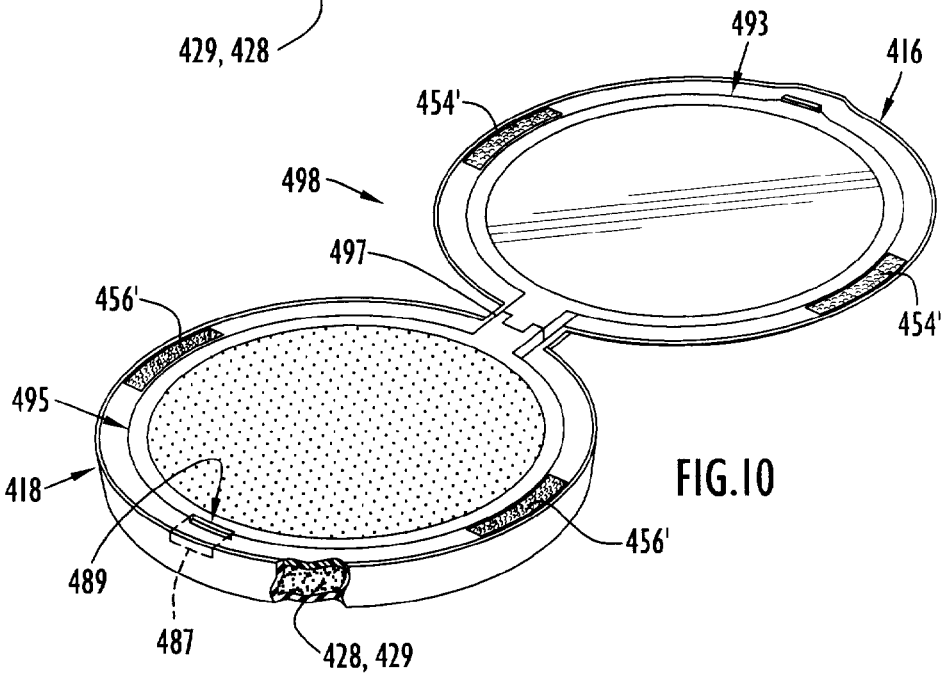
FIG. 10 is a perspective view of the protected industry-standard cosmetic container assembly, in an open position, formed when the industry-standard cosmetic container of FIG. 9 is installed in the protective shield.
Figure 11:
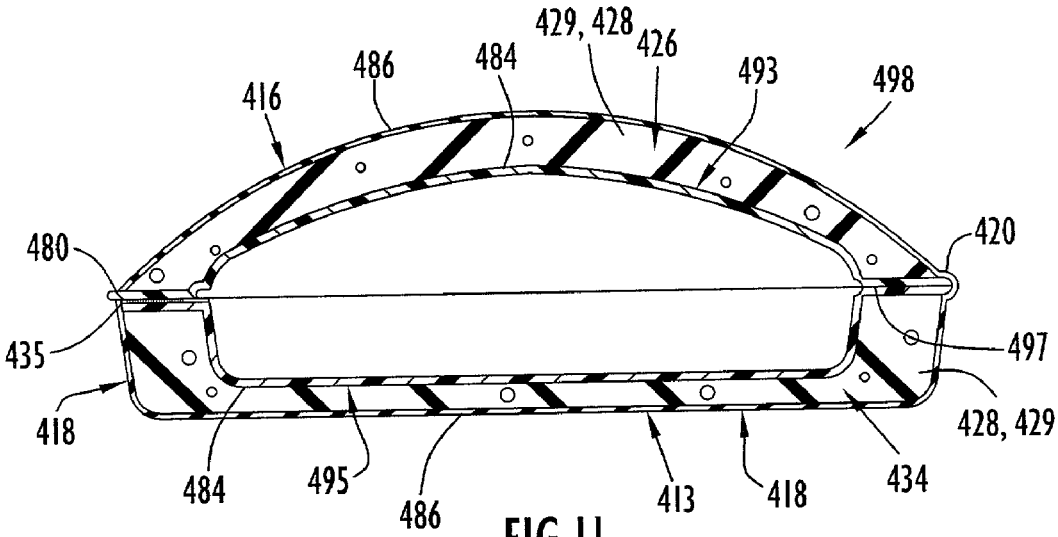
FIG. 11 is a side sectional view of the protected industry-standard cosmetic container assembly of FIG. 10 in a closed position.

A protective shield according to the present invention is illustrated at 411 in FIGS. 9–11. The protective shield 411 is illustrated as a hinged shield including housing 412 defining a shield lid 416 pivotally connected to a shield base 418 by a hinge 420. The shield lid 416 is pivotable around hinge 420, allowing lid 416 to be moved between an open shield position shown in FIGS. 9 and 10, and a closed shield position shown in FIG. 11. The shield 411 could, however, be designed without hinge 420 so that the shield lid 416 and the shield base 418 are separate, disconnected parts as shown in dotted lines in FIG. 9. Housing 412 is formed integrally, unitarily as a one-piece, shaped, distensible membrane 413 enclosing a distensible interior or cavity in the nature of a bladder. Where the shield lid and the shield base are formed as separate, disconnected parts, each of the shield lid and the shield base is formed integrally, unitarily as a one-piece, shaped, distensible membrane enclosing a distensible cavity. The membrane 413 has an interior face 484 and an exterior face 486 connected to one another in overlying relation along hinge 420 to form a bendable flap at hinge 20. Hinge 20 thusly divides the membrane 413 into shield lid 416 and shield base 418 containing separate shield lid and shield base cavities 426 and 434, respectively. However, the hinge 420 could be formed with a hinge cavity connecting the lid and base cavities as described for protected cosmetic container 10. The lid and base cavities 426 and 434, which are shown in FIG. 11, are each supplied with a thermally resistant insulant 429 and/or a material forming a shock absorbing body of material 428 such that the shield lid and shield base are each made substantially in their entireties of a shock absorbing body of material and/or a thermally resistant insulant as described above for protected cosmetic container 10.

The membrane 413 is shaped such that a lid recess 415 is defined in lid 416 by the interior face 484 of membrane 413 when the lid cavity 426 is supplied with the material forming shock absorbing body of material 428 and/or the thermally resistant insulant 429. The membrane 413 is also shaped such that a base recess 417 is defined in base 418 by the interior face 484 of membrane 413 when the base cavity 434 is supplied with the thermally resistant insulant 429 and/or the material forming shock absorbing body of material 428. Of course, the interior face 484 can be provided with or can be formed as interior shield lid and base members, similar to the interior lid and base members 22 and 30, with the lid and base recesses 415 and 417 defined in the interior shield lid and shield base members, respectively. It should be understood that the protective shield 411 can be designed in a manner similar to protected cosmetic container 10 with the shield lid 416 and the shield base 418 designed in the same manner as lid 16 and base 18 to include interior shield lid and shield base members connected to exterior shield lid and shield base members, respectively, to define the lid and base cavities. Conversely, the protected cosmetic container 10 can be designed in a manner similar to protective shield 411 with the lid 16 and base 18 together or individually comprising a one-piece distensible membrane as described above for shield lid 416 and shield base 418, with the membrane being shaped to define the wells 36. Also, the shield lid and shield base can include exterior and/or interior coverings as described for the protected cosmetic containers.

The lid and base recesses 415 and 417 are adapted to receive a lid 493 and a base 495, respectively, of an industry-standard cosmetic container 496 in which the lid is removably associated with the base to obtain open and closed positions for the cosmetic container. Cosmetic container 496 is a conventional hinged cosmetic container depicted as an industry-standard cosmetic compact in which the lid 493 is pivotally connected to the base 495 by a hinge 497. The lid and base recesses may correspond in size and shape to the size and shape of lid 493 and base 495, respectively, or may be deformable to accommodate the lid and base as discussed above for the wells of the protected cosmetic containers. The lid and base recesses may be provided with securing devices for removably or non-removably retaining the lid and base of the cosmetic container in the lid and base recesses, respectively, and the securing devices may be provided as separate components or parts or may be formed integrally, unitarily with the interior shield lid and base faces. The securing devices of the protective shield may comprise any one or more of the securing devices described herein for the protective cosmetic containers. The interior faces of the shield lid and shield base are in facing relation in the closed shield position such that the interior of the protective shield is enclosed and are in non-facing relation in the open shield position such that the interior of the protective shield is exposed as described above for the protected cosmetic containers. The protective shield may be provided with a seal for sealing the interior of the protective shield in the closed shield position as described herein for the protected cosmetic containers. A representative seal for the protective shield 411 may include a rim and shoulder, similar to rim 58 and shoulder 64, provided on the shield lid 416 and shield base 418, respectively, or vice versa. The rim and shoulder may be formed by appropriately shaping the interior face 484 of membrane 413. The rim and shoulder may also be formed on the interior shield lid and base members, where provided, as described for the interior lid and base members 22 and 30.

The peripheral configuration for the shield lid and shield base can be the same as or different from the peripheral configuration of the cosmetic container lid and base. For example, a square shaped protective shield can have recesses for accepting a circular shaped cosmetic container. The lid and base recesses can be located in the shield lid 416 and shield base 418 in centered or offset or non-centered locations depending on the hinge structure of the cosmetic container and/or the range of pivotal movement required for the cosmetic container lid to move between the open and closed cosmetic container positions. The shield lid 416 may be provided with a finger tab 480 along the front thereof diametrically opposite hinge 420. FIG. 9 illustrates the shield lid and shield base with Velcro closures 454' and 456' provided on the interior shield lid and base faces, respectively, diametrically opposite hinge 420. FIG. 10 illustrates Velcro closures 454' and 456' on the interior shield lid and base faces, respectively, at 90 degree spaced locations from hinge 420. It should be appreciated, however, that closures are not required for the protective shield since the protective shield can be maintained in the closed shield position by virtue of the cosmetic container being maintained in the closed cosmetic container position due to its own closures or other cosmetic container structure. Like the protected cosmetic containers, the exterior surfaces of the protective shield may be smooth, buffed, grooved, embossed, textured or finished in any other manner depending on desired appearance and/or functionality. Also, a non-hinged protective shield in which the shield lid 416 and the shield base 418 are separate, disconnected parts not connected by a hinge may be assembled with a hinged industry-standard cosmetic container, such as cosmetic container 496, in the same manner as described below for assembly of hinged industry-standard cosmetic container 496 with hinged protective shield 411. Furthermore, the hinged shield 411 may be used with some non-hinged industry-standard cosmetic containers.

The industry-standard cosmetic container 496 is of a type conventionally sold and marketed by cosmetic suppliers with cosmetics and, optionally, other cosmetic related objects such as mirrors, applicators and the like installed therein. The lid 493 and base 495 are typically made of rigid materials, such as plastic or metal, which provide little or no shock absorption protection for the housing of cosmetic container 496 and/or for the cosmetics and other contents contained therein. In addition, the lid 493 and base 495 are typically made of materials which are good heat conductors and which do not retain coldness well, such that the contents, particularly the cosmetics, are not protected from thermal damage since ambient heat is readily conducted to the interior of the housing. The industry-standard cosmetic container 496 may be installed in protective shield 411 and provided for sale as a protected industry-standard cosmetic container assembly 498 shown in FIGS. 10 and 11. Alternatively, the protective shield 411 may be provided for sale without an industry-standard cosmetic container installed therein, as shown in FIG. 9, in which case the protective shield may be sold and purchased as an accessory for industry-standard cosmetic containers. When the protective shield is purchased by a user as an accessory for an industry-standard cosmetic container, the user may install the industry-standard cosmetic container in the protective shield to form the protected industry-standard cosmetic container assembly 498.

In order to assemble protective shield 411 to the industry-standard cosmetic container 496 to form protected industry-standard cosmetic container assembly 498, the lid 493 and base 495 of industry-standard cosmetic container 496 are secured in the lid and base recesses 415 and 417, respectively, of protective shield 411 as shown in FIGS. 10 and 11. For the sake of simplicity, the cosmetic container 496 is not shown in cross-section in FIG. 11. The lid 493 and base 495 may be removably or non-removably secured in the lid and base recesses, respectively, in various ways. The lid 493 and base 495 may be permanently secured in the lid and base recesses 415 and 417 by glueing, for example. Compressibility and/or elasticity of the shock absorbing body of material 428 and/or the thermally resistant insulant 429 may itself be used to removably or non-removably retain the lid and base of the cosmetic container in the lid and base recesses of the protective shield in the same manner as described above for retention of objects in the wells of the protected cosmetic containers. In addition, the lid and base recesses 415 and 417 of an individual protective shield may accommodate cosmetic container lids and bases of various sizes and configurations in the same manner as described above for accommodation of various sized and shaped objects in the wells of the protected cosmetic containers.

When the industry-standard cosmetic container 496 is installed in protective shield 411, the lid 493 and base 495 are exteriorly covered and protected by protective shield 411, and it is desirable for the exteriors of the lid and base to be entirely or substantially entirely covered by the protective shield. The protective shield 411 can be moved from the open shield position shown in FIG. 10, in which the cosmetic container 496 is correspondingly in its open position, to the closed shield position shown in FIG. 11, in which the cosmetic container is correspondingly in its closed position. The shield is moved between the open and closed shield positions in the same manner as described above for the hinged protected cosmetic containers, and the lid 493 of the cosmetic container 496 secured within the protective shield 411 is correspondingly moved with the shield lid 416. In particular, the cosmetic container 496 is moved to its open position by pivoting shield lid 416 to the open position for the protective shield, as facilitated by finger tab 480. When shield lid 416 is pivoted to the open position, the lid 493 of cosmetic container 496 is also pivoted to obtain the open position for cosmetic container 496. When the shield lid 416 is pivoted to the closed shield position, the lid 493 of the cosmetic container is also pivoted to the closed position as a result of the shield lid movement. It will be seen from the foregoing that the cosmetic container 496 is used in its normal, routine manner when installed in the protective shield, and that operation of the protective shield to open and close the cosmetic container 496 is basically the same as operation of the cosmetic container itself.

In some cases, the industry-standard cosmetic container itself may need to be directly engaged by the user in order to obtain the open cosmetic container position. As an example, direct engagement of the industry-standard cosmetic container may be necessary where the cosmetic container is provided with a releasable closure or other structure requiring significant force to remove the cosmetic container lid from the cosmetic container base. It should be appreciated, therefore, that the protective shield 411 can be modified, such as with a notch or recess 487 shown in dotted lines in FIG. 10, to allow direct contact or engagement by the user with the industry-standard cosmetic container so that the lid 493 may be directly engaged and moved from the closed cosmetic container position to the open cosmetic container position with the shield lid 416 correspondingly moving therewith. As can be seen in FIG. 10, the recess 487 allows a front grasping portion 489 of the cosmetic container to be directly engaged by one or more fingers of the user.

The peripheral edges of the shield lid 416 and the shield base 418 are close to or in alignment with one another in the closed position to form a smooth, even junction 435 along the exterior of housing 412. Since the peripheral edges of lid 416 and base 418 are close to or in abutment with one another in the closed position, the protective shield 411 envelops the cosmetic container 496 in its entirety or substantially in its entirety. Where the lid and base of the protective shield are provided with shock absorbing bodies of material 428 or with a thermally resistant insulant 429 which also forms shock absorbing bodies of material, the lid and base of the protective shield are compressible and/or elastically deformable so that the protective shield protects the housing of the cosmetic container as well as its contents from damage due to shocks, thereby extending the life of the cosmetic container and its contents. The protective shield itself is also protected against structural damage. Where the lid and base of the protective shield are provided with thermally resistant insulant 429 or with shock absorbing bodies of material 428 which are also a thermally resistant insulant, the housing of the cosmetic container as well as its contents are protected from thermal damage. The thermally resistant insulant 429 may include a coldness retaining material, which may be activated as described above for cosmetic container 10. The shield lid and shield base are of sufficient cross-sectional thickness to provide the desired shock absorption and/or thermal protection. Where the cosmetic container is removably installed in the protective shield, the cosmetic container can be removed and the protective shield can be reused by installing another industry-standard cosmetic container therein. The protective shield is lightweight and does not add appreciably to the weight of the cosmetic container.

Figure 12:
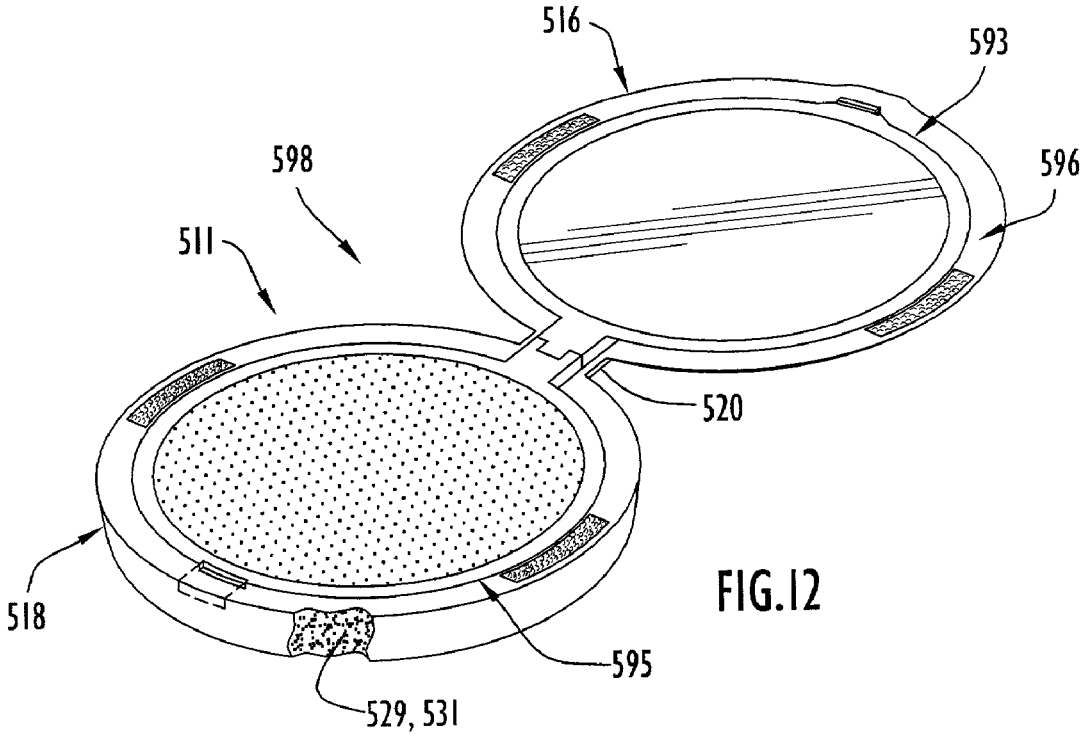
FIG. 12 is a perspective view of an alternative protective shield according to the present invention in an open position and showing a hinged industry-standard cosmetic container assembled to the alternative protective shield to form a protected industry-standard cosmetic container assembly.

An alternative protective shield according to the present invention is illustrated at 511 in FIG. 12. The protective shield 511 is shown with a hinged industry-standard cosmetic container 596 installed therein to form a protected industry-standard cosmetic container assembly 598. Protective shield 511 is shown as a hinged protective shield but could be a non-hinged protective shield not including hinge 520 as described and shown for protective shield 411. The protective shield 511 is similar to protective shield 411 except that the lid 516 and base 518 for protective shield 511 are formed in their entireties, respectively, of shock absorbing material 531 and/or thermally resistant insulant 529 having interior faces defining the lid and base recesses receiving the lid 593 and base 595, respectively, of cosmetic container 596. The shock absorbing material 531 and thermally resistant insulant 529 may be solid bodies; and, accordingly, protective shield 511 may be designed in a manner similar to protected cosmetic containers 110 and 210. Shock absorbing material 531 can be any solid or non-solid compressible and/or elastomeric shock absorbing material including the shock absorbing materials described above for the protected cosmetic containers and the padded, cushioned or shock absorbing materials described above for the exterior and interior coverings. The shock absorbing material 531 can also be a thermally resistant insulant. The thermally resistant insulant 529 can be any solid or non-solid thermally resistant insulant including the thermally resistant insulants described above. The thermally resistant insulant 529 can also form bodies of shock absorbing material in the lid 516 and base 518. The hinge 520 for protective shield 511 can be formed integrally, unitarily with the shield lid and shield base or as a separate component. The shield lid 516 and shield base 518 may be provided with interior lid and base members, respectively, similar to interior lid and base members 22 and 30 but with wells defining the lid and base recesses, respectively. The protective shield 511 may be covered on the outside with exterior coverings and/or on the inside with interior coverings as described above for the protected cosmetic containers. Where the shield lid 516 or the shield base 518 is provided with an interior member, an interior covering and/or an exterior covering, it is made substantially in its entirety of shock absorbing material and/or thermally resistant insulant.

Figure 13:
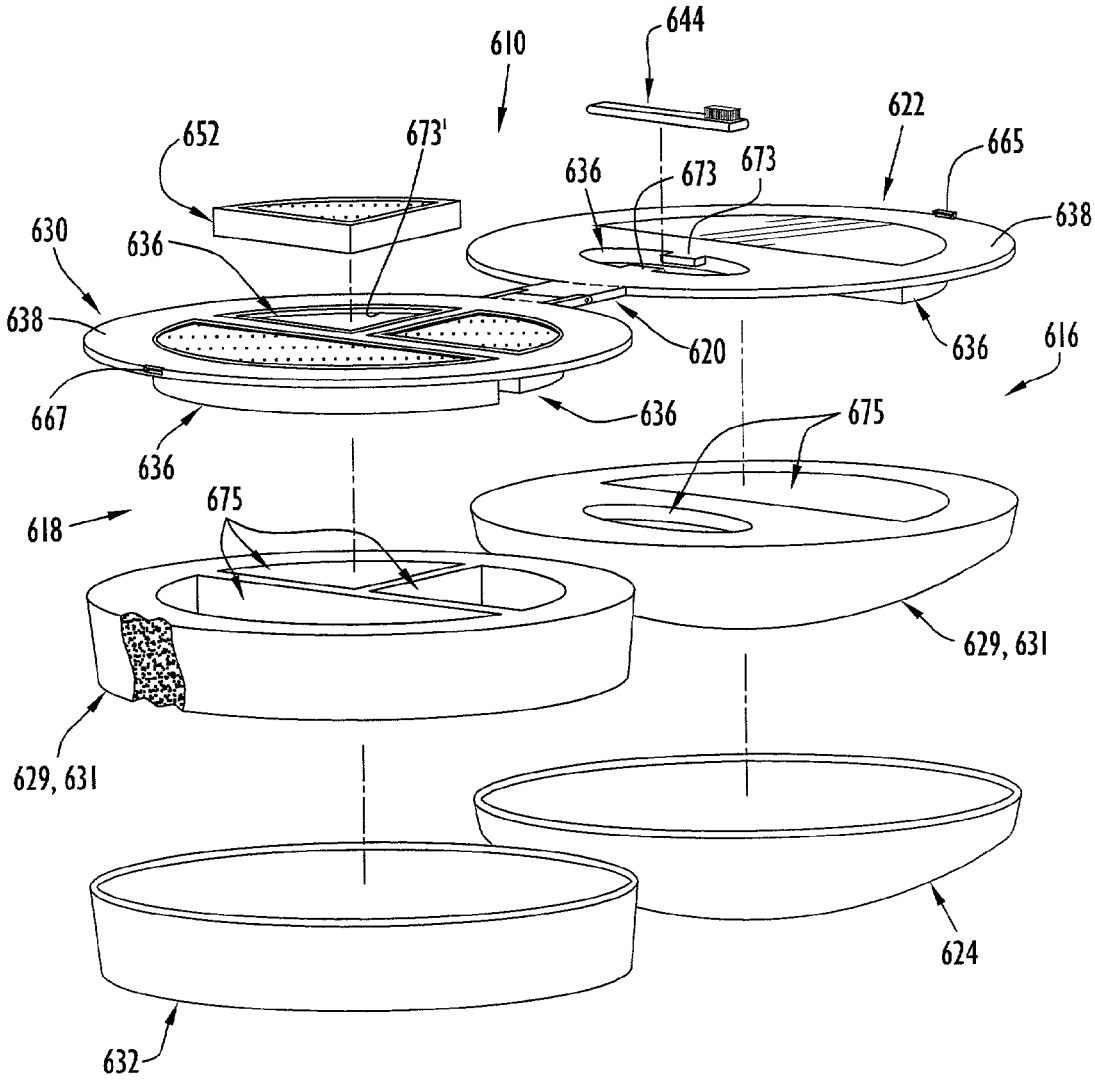
FIG. 13 is an exploded perspective view of an additional alternative protected cosmetic container according to the present invention.

FIG. 13 depicts an alternative and particularly preferred protected cosmetic container 610 according to the present invention. Protected cosmetic container 610 includes lid 616 and base 618 hingedly connected to lid 616; however, the hinge can be eliminated so that the lid 616 and base 618 are separate, disconnected parts as shown in dotted lines for interior lid and base members 622 and 630. Lid 616 includes interior lid member, face or wall 622, an exterior lid member, face or wall 624 and a shock absorbing material 631 and/or thermally resistant insulant 629 encased or encapsulated between the interior and exterior lid members so that the lid is substantially entirely made of shock absorbing material and/or thermally resistant insulant. Base 618 similarly includes interior base member, face or wall 630, an exterior base member, face or wall 632 and a shock absorbing material 631 and/or thermally resistant insulant 629 encased or encapsulated between the interior and exterior base members such that the base is made of shock absorbing material and/or thermally resistant insulant substantially in its entirety. The interior lid and base members 622 and 630 are similar to the interior lid and base members 22 and 30 and are molded plastic members connected by hinge 620 which, as pointed out above, can be eliminated as shown by dotted lines for a non-hinged cosmetic container. The hinge 620 is shown as a mechanical hinge similar to hinge 220, but may be formed in its entirety integrally, unitarily with the interior lid and base members 622 and 630 as described above for the interior lid and base members 22 and 30. The exterior lid and base members 624 and 632 are similar to exterior coverings 78. Depending on how the cosmetic container 610 is manufactured and assembled, the shock absorbing material 631 and/or thermally resistant insulant 629 can be solid, fluidic, non-solid or semi-solid. The shock absorbing material 631 and/or the thermally resistant insulant 629 are shown in FIG. 13 as constituting solid bodies for the lid 616 and base 618, respectively. The shock absorbing material 631 and/or thermally resistant insulant 629 may comprise a gel as described for shock absorbing material 131 and thermally resistant insulant 129. The shock absorbing material 631 could comprise compressible and/or elastomeric rubber as described for shock absorbing material 231. The shock absorbing material 631 could include silicone, cotton, batting, vinyl, multi-layer or multi-ply fabrics such as open weave, quilted and padded or cushioned fabrics, and/or any other compressible and/or elastomeric material capable of resiliently deforming or compressing to absorb shocks. The bodies of shock absorbing material 631 and/or thermally resistant insulant 629 have recesses 675 therein for accommodating the wells 636 which depend or protrude downwardly from the interior surfaces 638 of the interior lid and base members 622 and 630, respectively. Accordingly, each well 636 of the interior lid member 622 has a corresponding recess 675 in the body of shock absorbing material 631 and/or thermally resistant insulant 629 for lid 616, and each well 636 of the interior base member 630 has a corresponding recess 675 in the body of shock absorbing material 631 and/or thermally resistant insulant 629 for base 618. The body of shock absorbing material and/or thermally resistant insulant for each of the lid 616 and base 618 is shown as one piece. However, since the bodies of shock absorbing material and/or thermally resistant insulant are each encased between interior and exterior members, each body of shock absorbing material and/or thermally resistant insulant may include a plurality of individual pieces of shock absorbing material and/or thermally resistant insulant.

When the protected cosmetic container 610 is fully assembled, the peripheral edges of the interior and exterior lid members 622 and 624 meet or abut one another and/or are connected to one another to encase or encapsulate the shock absorbing material 631 and/or thermally resistant insulant 629 in its entirety therebetween. Similarly, the peripheral edges of the interior and exterior base members 630 and 632 meet or abut one another and/or are connected to one another to encase or encapsulate shock absorbing material 631 and/or thermally resistant insulant 629 in its entirety therebetween. The interior lid and base members may be provided with interior coverings as discussed above, and the exterior lid and base members may be provided with exterior coverings as also discussed above. Where only one of the first housing member or lid 616 and the second housing member or base 618 contains a cosmetic or other cosmetic-related object to be protected from shocks and/or thermal damage, the housing member containing the cosmetic or other cosmetic-related object to be protected may comprise the body of shock absorbing material 631 and/or thermally resistant insulant 629 encased between the exterior and interior members while the other housing member can be of generally conventional design as described above for the protected cosmetic containers.

The lid 616 and base 618 can each be initially formed as three separate components, i.e. interior lid/base member, body of shock absorbing material and/or thermally resistant insulant, and exterior lid/base member, assembled to one another during the manufacturing process. However, to simplify the number of manufacturing steps required, either or both of the interior and exterior members for the lid and base can be attached to the shock absorbing material and/or thermally resistant insulant as part of the manufacturing process. For example, the exterior lid member 624 can be placed in a mold for lid 616, and the shock absorbing material and/or thermally resistant insulant can be supplied to the mold as a fluid or semi-solid. As the shock absorbing material and/or thermally resistant insulant cures, it becomes bonded to the exterior lid member 624 as part of the molding process. Depending on the molding process and equipment, the interior lid member 622 can alternatively or additionally be bonded to the shock absorbing material and/or thermally resistant insulant as part of the molding process. Of course, the base 618 can be manufactured in the same manner as the lid.

The interior lid and base members 622 and 630 differ from the interior lid and base members 22 and 30 in that a releasable locking closure is provided on the interior lid and base members 622 and 630 and includes a locking finger or detent 665 on the interior lid member 622 and a locking aperture or notch 667 in the interior base member 630. The locking finger 665 is formed integrally, unitarily with the interior lid member 622 and protrudes interiorly from the interior surface 638 of interior lid member 622. The locking finger 665 is resilient so as to deflect and enter aperture 667 when the lid 616 is moved to the closed position. The locking finger 665 has a hook-like end to lockingly engage with the interior base member 630 when inserted in the aperture 667 to maintain the lid in the closed position. The locking finger 665 is selectively releasable from the interior base member 630 by pulling up on the lid 616 to permit movement of the lid from the closed position to the open position. The locking finger and aperture are located close to the peripheral edges of the interior lid and base members 622 and 630, respectively, and are located at discrete locations diametrically opposite hinge 620. In this way, the amount of interior space occupied by the closure is minimized, thereby increasing the amount of interior space available for cosmetic related objects.

Protected cosmetic container 610 is also representative of a protected cosmetic container in which the wells 636 have securing devices integrally, unitarily formed therewith for the cosmetic related objects. As seen for the oval shaped well of interior lid member 622, a securing device for applicator 644 includes opposing lips 673 protruding toward one another from opposite sides of the corresponding well. The lips 673 are located at or near the top of the well and are capable of resiliently deflecting to allow the applicator 644 to be inserted in and removed from the well. When the applicator 644 is inserted in the corresponding well, the protruding lips 673 block the mouth of the well, thereby confining the applicator to the well. Securing devices 671 for trays 652 include a lip 673' extending along the perimeter of the corresponding well as shown in FIG. 13 for the well 636 from which the tray 652 has been removed. The lip 673' protrudes at an angle from the side wall of the well and deflects to allow insertion of tray 652 in the well. When the tray is inserted in the well, the lip 673' exerts a wedging force on the tray so that the tray is secured in place. The force exerted on the tray by the lip 673' can be forcefully overcome to allow removal of the tray from the well, with the lip 673' resiliently deflecting to permit such removal. Of course, the lip 673' may be designed to exert a sufficiently strong force on the tray so that the tray is in effect non-removable.

Figure 14:
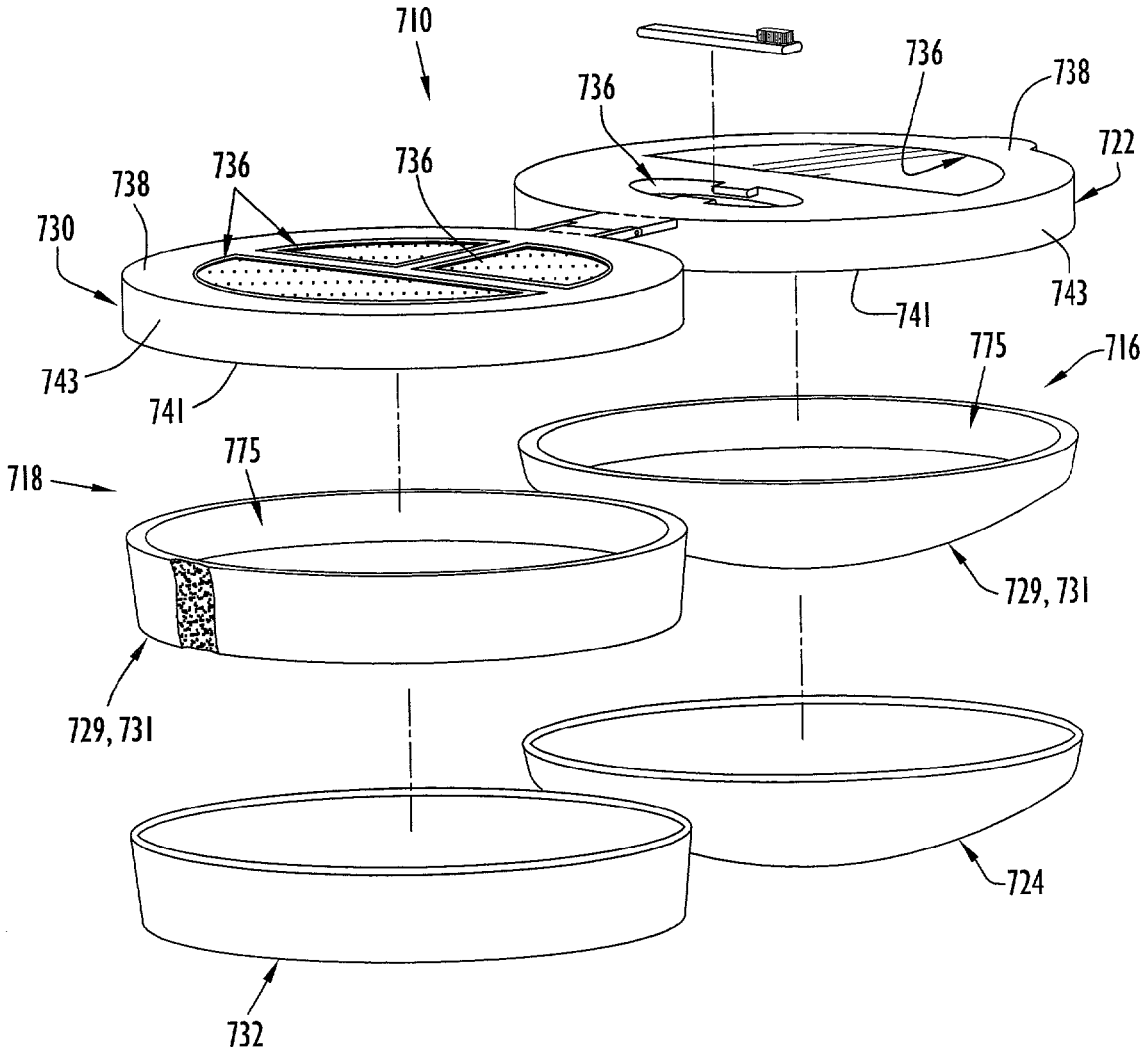
FIG. 14 is an exploded perspective view of yet a further alternative protected cosmetic container according to the present invention.

FIG. 14 illustrates an alternative protected cosmetic container 710, similar to protected cosmetic container 610, except that the bodies of shock absorbing material 731 and/or thermally resistant insulant 729 for lid 716 and base 718, respectively, each have a single recess 775 for accommodating a plurality of wells 736 of the interior lid and base members 722 and 730, respectively. The interior lid and base members 722 and 730 are different from the interior lid and base members 622 and 630 in that the interior lid and base members 722 and 730 each have an interior surface 738, an exterior surface 741, which may be planar, a peripheral side wall 743 joining the interior and exterior surfaces and a plurality of wells 736 with mouths opening on interior surface 738. The recesses 775 in the bodies of shock absorbing material 731 and/or thermally resistant insulant 729 receive the wells of the interior lid and base members 622 and 630, respectively. Accordingly, only a single recess 775 needs to be provided in each body of shock absorbing material and/or thermally resistant insulant to accommodate interior lid and base members that each have a plurality of wells. This arrangement may be desirable for simplification of the manufacturing process.

Figure 15:
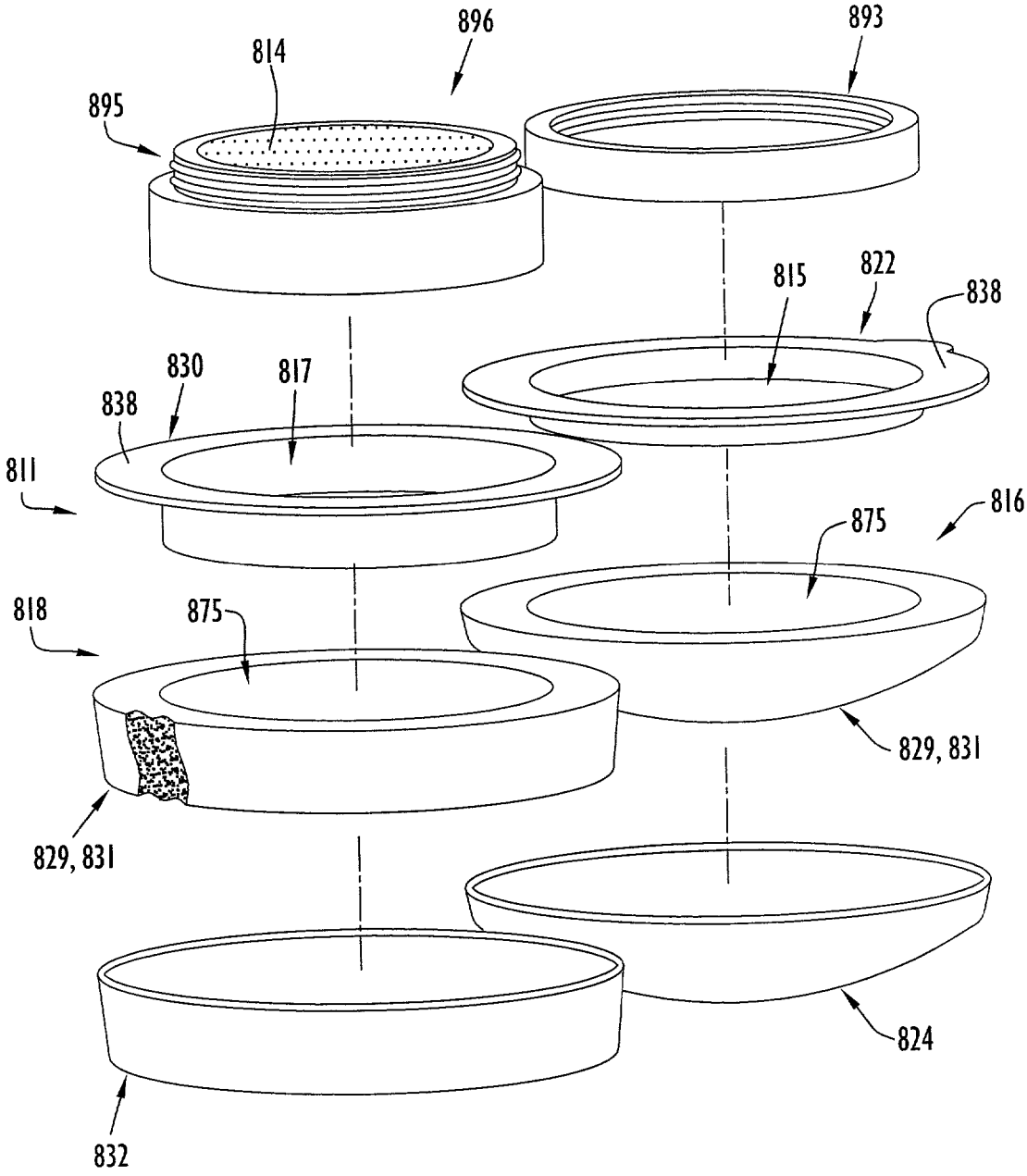
FIG. 15 is an exploded perspective view of an alternative protective shield according to the present invention and a non-hinged industry-standard cosmetic container for being installed in the protective shield to form a protected industry-standard cosmetic container assembly.

An alternative protective shield according to the present invention is illustrated at 811 in FIG. 15. The shield 811 is representative of a non-hinged protective shield adapted to receive a non-hinged industry-standard cosmetic container 896; however, the non-hinged protective shield 811 could also be used with hinged industry-standard cosmetic containers. Cosmetic container 896 includes a lid 893 removably associated with a base 895 to obtain open and closed cosmetic container positions, the lid 893 and base 895 being separate and disconnected parts that do not remain attached to one another in the open cosmetic container position. The cosmetic container 896 is illustrated in the open cosmetic container position in FIG. 15 with the lid 893 removed from the base 895 so that cosmetic 814 contained in the base is exposed and accessible. The cosmetic container 896 has a releasable closure shown as an internal thread on lid 893 for matingly engaging an external thread on an open upper end or neck of base 895 for disposition of lid 893 in a closed position for the cosmetic container. In the closed cosmetic container position, the lid 893 covers the open upper end of the base 895 and prevents access to the interior and, therefore, the contents of the container. The lid may be removably disposed on or associated with the base in many other ways including press fit or snap engagements with the base.

The protective shield 811 includes a shield lid 816 and a shield base 818 constructed in a manner similar to the lid and base of protected cosmetic container 610, except that the shield lid 816 and shield base 818 are separate, disconnected parts that do not remain connected or attached to one another in the open shield position. It should be appreciated, however, that the shield lid 816 and shield base 818 may be connected to one another, for example by a tether, to prevent undesired separation or loss of parts. Shield lid 816 includes interior shield lid member, face or wall 822, exterior shield lid member, face or wall 824 and shock absorbing material 831 and/or thermally resistant insulant 829 encased or encapsulated between the interior and exterior shield lid members. Shield base 818 similarly includes interior shield base member, face or wall 830, exterior shield base member, face or wall 832 and shock absorbing material 831 and/or thermally resistant insulant 829 encased or encapsulated between the interior and exterior shield base members. The shock absorbing material 831 and/or thermally resistant insulant 829 for the shield lid and shield base are shown as but do not have to be solid bodies, respectively. The interior shield lid member 822, which is similar to interior lid member 22, has a well defining a lid recess 815 therein for receiving lid 893 of cosmetic container 896. The interior shield base member 830, which is similar to interior base member 30, has a well defining a base recess 817 therein for receiving base 895 of cosmetic container 896. The lid 893 and base 895 may be removably or non-removably installed in the lid and base recesses 815 and 817, respectively, as discussed above for shield 411. The interior shield lid and base members 822 and 830 may be provided with securing devices for removably or non-removably securing the lid 893 and base 895 in the lid and base recesses, respectively, and the securing devices may be formed integrally, unitarily with the interior shield lid and base members or as separate components. The bodies of shock absorbing material 831 and/or thermally resistant insulant 829 have recesses 875 therein, respectively, for receiving the lid and base recesses 815 and 817, respectively, of the interior shield lid and base members 822 and 830. When the shield lid 816 and shield base 818 are assembled, the shock absorbing material and/or thermally resistant insulant is encased or encapsulated between the interior and exterior shield lid and base members, respectively, as described for lid 616 and base 618.

Preferably, the exteriors of lid 893 and base 895 of cosmetic container 896 are entirely or substantially entirely covered by the shield lid 816 and shield base 818, respectively, when the cosmetic container 896 is assembled with the protective shield 811 to form a protected industry-standard cosmetic container assembly. In the case of industry-standard cosmetic container 896, the thread at the upper end of base 895 remains uncovered by the shield base 818 so that the lid 893 may be engaged with the base 895 to obtain the closed position for the cosmetic container. The protective shield 811 does not interfere with normal use and operation of the cosmetic container 896 in that the lid 893 may be rotated or screwed on and off of the base 895 in the normal manner of use while the lid 893 and base 895 remain disposed in the shield lid 816 and shield base 818, respectively.

Figure 16:
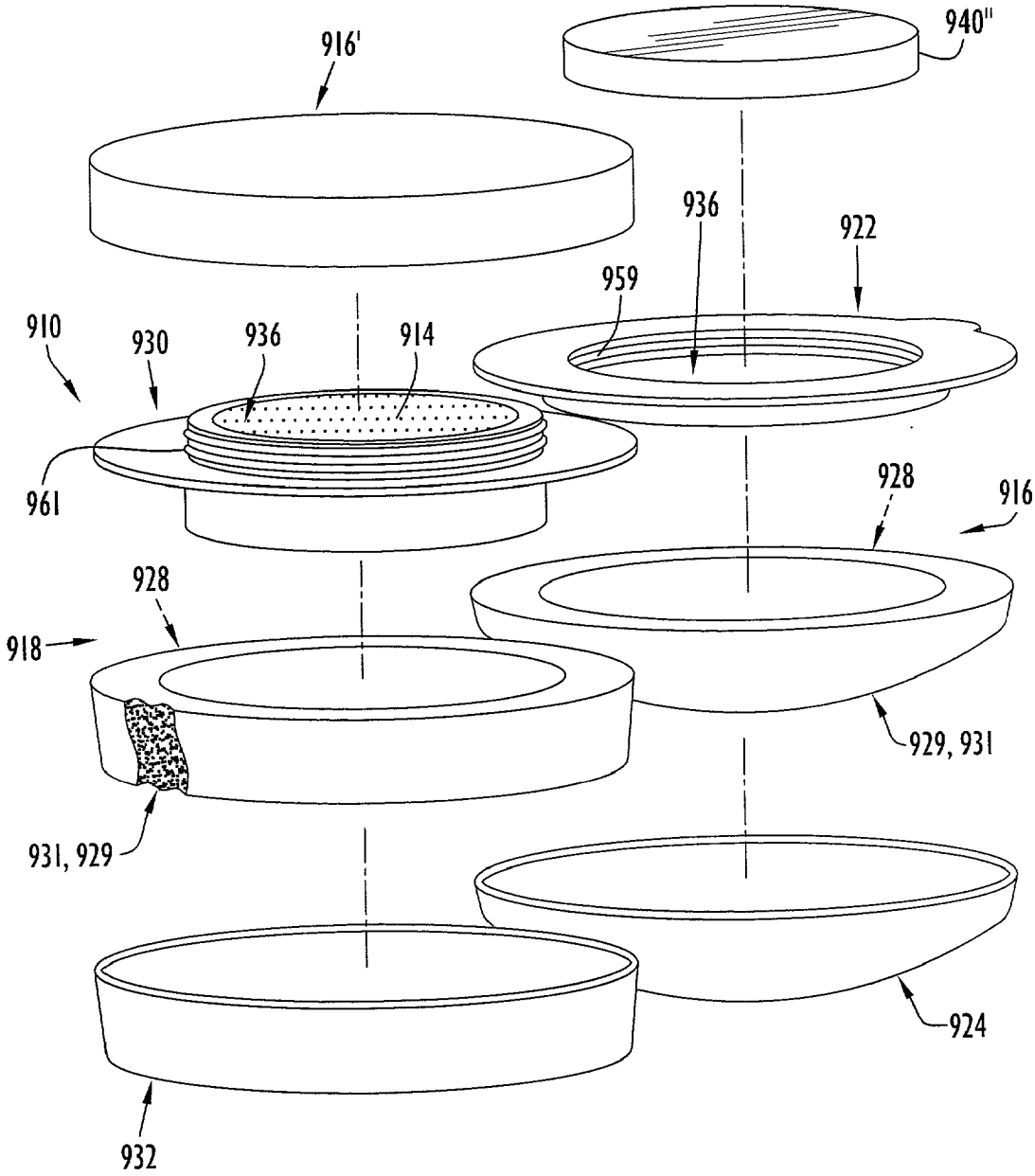
FIG. 16 is an exploded perspective view of another protected cosmetic container according to the present invention.

Another protected cosmetic container according to the present invention is illustrated at 910 in FIG. 16 and is representative of a non-hinged protected cosmetic container in which the lid 916 and the base 918 are separate and disconnected parts that do not remain connected or attached to one another in the open position for the protected cosmetic container. The lid 916 and base 918 are constructed in a manner similar to the lid and base of protected cosmetic container 610 as well as the lid and base of protective shield 811. Lid 916 includes interior lid member 922, exterior lid member 924 and shock absorbing material 931 and/or thermally resistant instant 929 encased or encapsulated between the interior and exterior lid members. Base 918 includes interior base member 930, exterior base member 932 and shock absorbing material 931 and/or thermally resistant insulant 929 encased or encapsulated between the interior and exterior base members. The shock absorbing material 931 and/or thermally resistant insulant 929 are shown as constituting solid bodies for the lid 916 and the base 918, respectively, but need not constitute solid bodies. Interior lid member 922 is similar to interior lid member 22 except that interior lid member 922 has a single well 936 with an internal thread 959 at an interior end of the well. The well for lid 916 may be without any cosmetic related objects, or may have one or more cosmetic-related objects, such as mirror 940, installed therein. The well 936 of interior lid member 922 may be empty when no cosmetic related objects are installed therein; and, depending on the design of the closure used to secure the lid 916 on base 918 in the closed position, the well 936 in the interior lid member 922 may be eliminated. Interior base member 930 is similar to interior base member 30 except that interior base member 930 has a single well 936 containing a cosmetic 914 supplied directly to the well without being disposed in a tray. Also, interior base member 930 has an upwardly protruding neck carrying an external thread 961 for cooperatively engaging the internal thread 959 to form a releasable closure for removably securing the lid 916 on the base 918 in the closed position. Of course, various closures can be used in the protected cosmetic container 910 including the rim and shoulder, magnets, and Velcro closures disclosed herein, and the lid 916 can be removably secured on the base 918 with a press fit, a friction fit, a snap fit, a rotatable engagement, etc. When the lid 916 is disposed on the base 918 in the closed position, the peripheral edges of the lid and base preferably meet or are in abutment to form a smooth, even junction along the exterior of the protected cosmetic container. The bodies of shock absorbing material 931 and/or thermally resistant insulant 929 may be the same as the bodies of shock absorbing material described above. Alternatively, the interior lid and base members can be assembled to the exterior lid and base members, respectively, to enclose lid and base cavities for being supplied with a material forming shock absorbing bodies of material 928 and/or thermally resistant insulant 929 as shown in dotted lines and as described above for protected cosmetic container 10. As explained above, the lid could be designed in a generally conventional manner without shock absorption and/or thermal protection, as represented by lid 916', since only the base 918 contains a cosmetic-related object to be protected.

The structure, features and principles disclosed herein for the protected cosmetic containers may be embodied in any hinged or non-hinged protected cosmetic container having a lid removably associated with a base. The structure, features and principles disclosed herein for the protected cosmetic containers may be embodied in any of the protective shields. The structure, features and principles disclosed herein for the protective shields may be embodied in any of the protected cosmetic containers. The protected cosmetic containers and protective shields are resiliently compressible and/or deformable to absorb shocks and/or are resistant to conduction of ambient heat to their interiors to provide thermal protection therefor. The protected cosmetic containers and protective shields can be provided with or without various closures, sealing devices and/or securing devices formed as separate components or formed integrally, unitarily with the protected cosmetic containers and protective shields. The functions of closure and sealing can be performed by the same part or structure or by different parts or structures. The closures, sealing devices and securing devices disclosed herein can be used interchangeably in either or both of the protected cosmetic containers and protective shields of the present invention. The lids and bases of the protected cosmetic containers and protective shields may be structurally connected to one another, for example by hinges or tethers, or may be separate and disconnected parts. Either or both of the lids and bases of the protected cosmetic containers and protective shields may be provided with or without a corresponding interior lid member or interior base member, respectively. Either or both of the lids and bases of the protected cosmetic containers and protective shields may be provided with or without interior (internal) and/or exterior (external) coverings comprising one or more layers. The internal and/or external coverings may be designed to provide shock absorption and/or thermal protection. The various features disclosed herein can be used interchangeably in the various protected cosmetic containers and shields. The protective shields can be constructed in any of the manners disclosed herein for the protected cosmetic containers, and vice versa. Protective shields in which the lids and bases are structurally connected may be used with industry-standard cosmetic containers in which the lids and bases are structurally connected or are separate and disconnected parts. Protective shields in which the lids and bases are separate, disconnected parts may be used with industry-standard cosmetic containers in which the lids and bases are structurally connected or are separate and disconnected parts. In the protected cosmetic containers according to the present invention, one or more cosmetic-related objects, such as cosmetics, can be disposed in either or both the lids and bases. The cosmetics may be supplied to the wells of the protected cosmetic containers directly, or may be supplied to trays installed in the wells. Depending on the design of the protected cosmetic containers and/or the cosmetic-related objects or objects to be installed therein, either or both of the lids and bases can be designed with shock absorption and/or thermal protection. Where the lids and bases are both designed with shock absorption and/or thermal protection, the lids and bases can be designed with different types or forms of shock absorption and/or thermal protection. As an example, the lids may be designed as bladders containing shock absorbing bodies of material and/or a thermally resistant insulant while the bases are made of solid bodies of shock absorbing material and/or thermally resistant insulant. Lids not designed with shock absorption and/or thermal protection may be designed in a generally conventional manner to removably or releasably engage with shock absorbing and/or thermally protected bases. Similarly, bases not designed with shock absorption and/or thermal protection may be designed in a generally conventional manner to removably or releasably engage with shock absorbing and/or thermally protected lids.

The lids and/or bases of the cosmetic containers and/or shields are made entirely or substantially entirely of a shock absorbing material, a thermally resistant insulant and/or a material forming a shock absorbing body of material. Where the lids and/or bases of the cosmetic containers and/or shields are constructed as a bladder defining a cavity for being supplied with a thermally resistant insulant and/or a material forming a shock absorbing body of material, the insulant and/or material may be gaseous, non-gaseous, fluidic or non-fluidic in an initial state when supplied to the cavity from externally thereof. Subsequent to being supplied to the cavity, the insulant and/or material may remain in the same state as the initial state or may assume another state, for example by curing, which may be different from the initial state. Subsequent to being supplied to the cavity, the insulant and/or material may be gaseous, non-gaseous, fluidic, non-fluidic, flowable, non-flowable, solid or semi-solid. Where the lids and/or bases of the cosmetic containers and/or shields are made in their entireties of shock absorbing material and/or thermally resistant insulant, the material and/or insulant constitutes a non-flowing body. Lids and/or bases constituting non-flowing bodies of material and/or insulant may be provided with interior members, interior coverings and/or exterior coverings while still being comprised substantially entirely of the material and/or insulant. Where the lids and/or bases of the cosmetic containers and/or shields comprise a shock absorbing material and/or thermally resistant insulant encapsulated between interior and exterior members, the material and/or insulant may be fluidic, non-fluidic, non-solid, solid or semi-solid, for example.

In as much as the present invention is subject to many variations, modifications and changes in detail, it is intended that all subject matter discussed above or shown in the accompanying drawings be interpreted as illustrative only and not be taken in a limiting sense.

What is claimed is:

1. A protected container comprising a housing including first and second housing members each comprising an interior face and an exterior face, at least one of said first and second housing members being made at least substantially in its entirety as a body of non-cellular and non-foamed compressively deformable shock absorbing material, said container having a closed position and an open position, said housing including a well for receiving an object, said well being enclosed between said interior faces of said first and second housing members in said closed position and being exposed in said open position, and further including a skin disposed over said body.

2. The protected container as recited in claim 1 wherein said first housing member is disposed over said second housing member in said closed position with said interior faces in facing relation.

3. The protected container as recited in claim 2 wherein said first housing member is separable from said second housing member to obtain said open position.

4. The protected container as recited in claim 3 wherein said first housing member comprises a base, said second housing member comprises a lid, and further comprising a hinge pivotally connecting said lid to said base for movement between said closed and open positions.

5. The protected container as recited in claim 1 wherein said well is disposed in said interior face of said at least one of said first and second housing members.

6. The protected container as recited in claim 5 wherein said well is deformable to permit the size and shape of said well to vary.

7. The protected container as recited in claim 1 wherein said non-cellular and non-foamed compressively deformable shock absorbing material is a vinyl.

8. The protected container as recited in claim 1 wherein said non-cellular and non-foamed compressively deformable shock absorbing material constitutes a thermally resistant insulant.

9. The protected container as recited in claim 8 wherein said thermally resistant insulant constitutes a coldness retaining material capable of being intentionally cooled to obtain and retain a cooled state.

10. The protected container as recited in claim 1 and further comprising a cosmetic received in said well.

11. A protected container comprising a housing including first and second housing members each comprising an interior face and an exterior face, at least one of said first and second housing members being made at least substantially in its entirety as a body of non-cellular and non-foamed compressively deformable shock absorbing material, said container having a closed position and an open position, said housing including a well for receiving an object, said well being enclosed between said interior faces of said first and second housing members in said closed position and being exposed in said open position, wherein each of said first and second housing members is made at least substantially in its entirety as a body of non-cellular and non-foamed compressively deformable shock absorbing material, and further including an exterior skin over each of said exterior faces.

12. The protected container as recited in claim 11 and further including an interior skin over each of said interior faces.

13. A protected container comprising a housing including first and second housing members each comprising an interior face and an exterior face, at least one of said first and second housing members being made at least substantially in its entirety as a body of non-cellular and non-foamed compressively deformable shock absorbing material, said container having a closed position and an open position, said housing including a well for receiving an object, said well being enclosed between said interior faces of said first and second housing members in said closed position and being exposed in said open position, wherein said non-cellular and non-foamed compressively deformable shock absorbing material is a polyurethane gel.

14. A protected container comprising a housing including first and second housing members each comprising an interior face and an exterior face, at least one of said first and second housing members being made at least substantially in its entirety as a body of non-cellular and non-foamed compressively deformable shock absorbing material, said container having a closed position and an open position, said housing including a well for receiving an object, said well being enclosed between said interior faces of said first and second housing members in said closed position and being exposed in said open position, wherein said non-cellular and non-foamed compressively deformable shock absorbing material is a silicone gel.

15. A protected container comprising a housing including first and second housing members each comprising an interior face and an exterior face, said interior face of at least one of said first and second housing members comprising an interior face member, said exterior face of said at least one of said first and second housing members comprising an exterior face member, said at least one of said first and second housing members comprising a shock absorbing gel material encapsulated between said interior face member and, said exterior face member, said container having a closed position and an open position, said housing including a well for receiving an object, said well being enclosed between said interior faces of said first and second housing members in said closed position and being exposed in said open position.

16. The protected container as recited in claim 15 wherein said first housing member is disposed over said second housing member in said closed position with said interior faces in facing relation.

17. The protected container as recited in claim 16 wherein said first housing member is separable from said second housing member to obtain said open position.

18. The protected container as recited in claim 17 wherein said first housing member comprises a base, said second housing member comprises a lid, and further comprising a hinge pivotally connecting said lid to said base for movement between said closed and open positions.

19. The protected container as recited in claim 15 wherein said well is disposed in said interior face member.

20. The protected container as recited in claim 15 wherein said interior face of each of said first and second housing members comprises an interior face member, said exterior face of each of said first and second housing members comprises an exterior face member, and each of said first and second housing members comprises a shock absorbing gel material encapsulated between said interior face member and said exterior face member of said housing member.

21. The protected container as recited in claim 20 wherein each of said first and second housing members comprises a skin covering said shock absorbing gel material and defining said interior face member and said exterior face member of said housing member, each of said interior face members being disposed on a substrate of greater rigidity than said gel material, said well being formed in said substrate of said at least one of said first and second housing members.

22. The protected container as recited in claim 21 and further comprising a hinge pivotally connecting said substrates.

23. The protected container as recited in claim 15 wherein said shock absorbing gel material comprises a silicone material.

24. The protected container as recited in claim 15 and further comprising a cosmetic received in said well.

25. The protected container as recited in claim 15 wherein said gel material encapsulated between said interior face member and said exterior face member is fluidic.

26. The protected container as recited in claim 15 wherein said gel material is bonded to at least one of said interior face member or said exterior face member by being placed in contact with said at least one of said interior face member or said exterior face member while said gel material is in a fluidic form and thereafter curing while in contact with said at least one of said interior face member or said exterior face member.

27. A protected container comprising a housing comprising a first housing member and a second housing member each comprising an interior surface and an exterior surface, said exterior surface of at least one of said first and second housing members being flexible, said interior surface of said at least one of said first and second housing members comprising a hard substrate spaced from said flexible exterior surface of said at least one of said first and second housing members by a body of soft thermoplastic material molded onto said substrate and extending along said flexible exterior surface such that said at least one of said first and second housing members is compressively deformable along said flexible exterior surface, said container having a closed position and an open position, said housing including a well for receiving an object, said well being enclosed between said interior surfaces in said closed position and being exposed in said open position, at least a portion of said flexible exterior surface being exposed in said closed position, and said at least one of said first and second housing members being compressively deformable along at least substantially the entirety of said at least a portion of said flexible exterior surface to absorb shocks.

28. The protected container as recited in claim 27 wherein said first housing member is disposed over said second housing member in said closed position with said interior surfaces in facing relation.

29. The protected container as recited in claim 28 wherein said first housing member is separable from said second housing member to obtain said open position.

30. The protected container as recited in claim 29 wherein said first and second housing members are pivotally connected for movement between said closed and open positions.

31. The protected container as recited in claim 27 wherein said well is formed in said substrate.

32. The protected container as recited in claim 31 wherein said exterior surface of each of said first and second housing members is flexible, said interior surface of each of said first and second housing members comprises a hard substrate spaced from said flexible exterior surface of said housing member by a body of soft thermoplastic material molded onto said substrate and extending along said flexible exterior surface of said housing member such that each of said first and second housing members is compressively deformable along said flexible exterior surface of said housing member.

33. The protected container as recited in claim 27 wherein said thermoplastic material is a thermoplastic elastomer.

34. The protected container as recited in claim 27 wherein said thermoplastic material is a thermoplastic rubber.

35. The protected container as recited in claim 27 wherein said substrate is made of plastic.

36. The protected container as recited in claim 27 wherein said thermoplastic material is injection molded onto said substrate.

37. The protected container as recited in claim 27 and further comprising a cosmetic received in said well.

38. The protected container as recited in claim 27 wherein said flexible exterior surface of said at least one of said first and second housing members is formed by a fabric disposed over said soft thermoplastic material.

39. The protected container as recited in claim 27 wherein said substrate is circumscribed by a peripheral edge, said flexible exterior surface of said at least one of said first and second housing members comprises a flexible exterior face member having a peripheral edge adjacent said peripheral edge of said substrate.

40. A protected container comprising a housing including first and second housing members each comprising an interior face and an exterior face, said interior face of at least one of said first and second housing members comprising an interior face member and said exterior face of said at least one of said first and second housing members comprising a flexible exterior face member connected to said interior face member to define a cavity enclosed by said interior face member and said flexible exterior face member of said at least one of said first and second housing members, said container having a closed position and an open position, said housing including a well for receiving an object, said well being enclosed between said interior faces of said first and second housing members in said closed position and being exposed in said open position; and a flowable quantity of material supplied to said cavity from externally of said container and forming a shock absorbing deformable body of material along said flexible exterior face member by which said at least one of said first and second housing members is deformable along said flexible exterior face member.

41. The protected container as recited in claim 40 wherein said first housing member is disposed over said second housing member in said closed position with said interior faces in facing relation.

42. The protected container as recited in claim 41 wherein said first housing member is separable from said second housing member to obtain said open position.

43. The protected container as recited in claim 42 wherein said first housing member comprises a base, said second housing member comprises a lid, and further including a hinge pivotally connecting said lid to said base for movement between said closed and open positions.

44. The protected container as recited in claim 43 wherein said hinge is formed integrally, unitarily with said lid and said base.

45. The protected container as recited in claim 43 wherein said hinge includes one or more mechanical components formed separately from said lid and said base.

46. The protected container as recited in claim 40 wherein said well is disposed in said interior face of said at least one of said first and second housing members.

47. The protected container as recited in claim 46 comprising a plurality of said wells in said interior face of said at least one of said first and second housing members and a cosmetic disposed in each of said wells.

48. The protected container as recited in claim 40 wherein said interior face of each of said first and second housing members comprises an interior face member and said exterior face of each of said first and second housing members comprises a flexible exterior face member connected to said interior face member of said housing member to define a cavity enclosed by said interior face member and said flexible exterior face member of said housing member, and said material is supplied to each of said cavities from externally of said container to form a shock absorbing deformable body of material along said flexible exterior face member of each of said first and second housing members by which said first and second housing members are deformable along said flexible exterior face members.

49. The protected container as recited in claim 48 wherein said cavities are separate from one another.

50. The protected container as recited in claim 40 and further comprising a cosmetic received in said well.

51. The protected container as recited in claim 50 wherein said cosmetic is disposed in a tray removably mounted in said well.

52. The protected container as recited in claim 50 wherein said cosmetic is disposed in a tray non-removably mounted in said well.

53. The protected container as recited in claim 40 and further including at least one port in said housing for supplying said material to said cavity.

54. The protected container as recited in claim 40 wherein said interior face member and said flexible exterior face member form a one-piece bladder.

55. The protected container as recited in claim 54 wherein said bladder is stretchable.

56. A protected container comprising a housing comprising a first housing member and a second housing member each having an interior face and an exterior face, and a well disposed in said interior face of at least one of said first and second housing members for receiving an object, said container having a closed position and an open position, said well being enclosed between said interior faces of said first and second housing members in said closed position and being exposed in said open position;

a cosmetic contained in said well; and a coldness retaining material contained in said housing and disposed about said well in said closed position, said coldness retaining material being encapsulated between said interior and exterior faces of each of said first and second housing members, said interior and exterior faces of said first housing member enclosing a cavity, said interior and exterior faces of said second housing member enclosing a cavity, said coldness retaining material being supplied to said cavities from externally of said housing, said coldness retaining material being intentionally exposed to cold to obtain a cooled state and retaining said cooled state thereafter when not exposed to cold to protect said cosmetic.

57. The protected container as recited in claim 56 wherein said first housing member is disposed over said second housing member in said closed position with said interior faces in facing relation.

58. The protected container as recited in claim 57 wherein said first housing member is separable from said second housing member to obtain said open position.

59. The protected container as recited in claim 58 wherein said first and second housing members are pivotally connected for movement between said closed and open positions.

60. A protected container comprising a housing comprising a first housing member and a second housing member each having an interior face and an exterior face, and a well for receiving an object, said container having a closed position and an open position, said well being enclosed between said interior faces of said first and second housing members in said closed position and being exposed in said open position;

a cosmetic contained in said well; and a coldness retaining material contained in said housing and disposed about said well in said closed position, said coldness retaining material being intentionally exposed to cold to obtain a cooled state and retaining said cooled state thereafter when not exposed to cold to protect said cosmetic, wherein said coldness retaining material is a fluid.

61. A protected container comprising a housing comprising a first housing member and a second housing member each having an interior face and an exterior face, and a well for receiving an object, said container having a closed position and an open position, said well being enclosed between said interior faces of said first and second housing members in said closed position and being exposed in said open position;

a cosmetic contained in said well; and a coldness retaining material contained in said housing and disposed about said well in said closed position, said coldness retaining material being intentionally exposed to cold to obtain a cooled state and retaining said cooled state thereafter when not exposed to cold to protect said cosmetic, wherein said coldness retaining material includes a gel.

62. A protected container comprising a housing including first and second housing members each comprising an interior face and an exterior face, at least one of said first and second housing members being made at least substantially in its entirety as a body of non-cellular and non-foamed compressively deformable shock absorbing material, said container having a closed position and an open position, said housing including a well for receiving an object, said well being enclosed between said interior faces of said first and second housing members in said closed position and being exposed in said open position, wherein said shock absorbing material is a fluidic gel.

63. A protected container comprising a housing including first and second housing members each comprising an interior face and an exterior face, at least one of said first and second housing members being made at least substantially in its entirety as a body of non-cellular and non-foamed compressively deformable shock absorbing material, said container having a closed position and an open position, said housing including a well for receiving an object, said well being enclosed between said interior faces of said first and second housing members in said closed position and being exposed in said open position, wherein said shock absorbing material has a hardness close to liquid in consistency.

* * * * *